US005503969A

United States Patent [19]

Uehara et al.

[11] Patent Number: 5,503,969

[45] Date of Patent: Apr. 2, 1996

[54] HEAT-DEVELOPABLE COLOR LIGHT-SENSITIVE MATERIAL

[75] Inventors: Kazuki Uehara; Hiroo Takizawa, both of Kanagawa, Japan

[73] Assignee: Fuji Photo Film Co., Ltd., Kanagawa, Japan

[21] Appl. No.: 412,005

[22] Filed: Mar. 28, 1995

[30] Foreign Application Priority Data

Mar. 29, 1994 [JP] Japan ..... 6-081139

[51] Int. Cl.[6] ..... G03C 8/40; G03C 8/10

[52] U.S. Cl. ..... 430/559; 430/203; 430/218; 430/617

[58] Field of Search ..... 430/203, 218, 430/617, 559

[56] References Cited

U.S. PATENT DOCUMENTS

| | | | |
|---|---|---|---|
| 4,622,289 | 11/1986 | Hirai et al. | 430/203 |
| 4,639,418 | 1/1987 | Yabuki et al. | 430/203 |
| 4,650,749 | 3/1987 | Sato et al. | 430/203 |
| 4,731,321 | 3/1988 | Sato et al. | 430/203 |
| 4,772,544 | 9/1988 | Hirai | 430/203 |

FOREIGN PATENT DOCUMENTS

| | | | |
|---|---|---|---|
| 63-306439 | 12/1988 | Japan | G03C 1/06 |

*Primary Examiner*—Richard L. Schilling

*Attorney, Agent, or Firm*—Sughrue, Mion, Zinn, Macpeak & Seas

[57] ABSTRACT

A heat-developable color light-sensitive material is described, which comprises a light-sensitive silver halide, a binder, a dye-donating compound and at least one compound represented by the following formula (I) on a support:

(I)

wherein $R_1$ represents an alkyl group having from 1 to 30 carbon atoms, an alkenyl group having from 2 to 30 carbon atoms, a cycloalkyl group having from 3 to 30 carbon atoms, or an aryl group having from 6 to 36 carbon atoms; $R_2$, $R_3$, $R_4$ and $R_5$ each independently represents a hydrogen atom, an alkyl group having from 1 to 30 carbon atoms, or an alkenyl group having from 2 to 30 carbon atoms; m represents an integer of from 0 to 10; and n represents 0 or 1; with the proviso that, when m is an integer of from 1 to 10, n is 0; when n is 1, m is 0; when m is an integer of from 2 to 10, the plurality of $R_2$ groups may be the same or different, and the plurality of $R_3$ groups may be the same or different; $R_1$ and $R_2$, $R_2$ and $R_3$, or $R_4$ and $R_5$ each may be bonded to each other to form a ring; and the compound represented by formula (I) has from 10 to 50 total carbon atoms.

2 Claims, No Drawings

HEAT-DEVELOPABLE COLOR LIGHT-SENSITIVE MATERIAL

FIELD OF THE INVENTION

The present invention relates to a heat-developable color light-sensitive material and, in particular, to a heat-developable color light-sensitive material which is fogged little when heat-developed and which involves little sensitivity fluctuation relative to the variation of the developing temperature.

BACKGROUND OF THE INVENTION

Various heat-developable light-sensitive materials are known and, for example, such materials and light-sensitive processes of processing them are described in Bases of Photographic Engineering, Edition of Nonsilver Photography (published by Corona Publishing Co., 1982) , pages 242 to 255 and U.S. Pat. No. 4,500,626.

In addition, a method of forming a color image by coupling reaction of an oxidation product of a developing agent and a coupler is described in, for example, U.S. Pat. Nos. 3,761,270 and 4,021,240. A method of forming a positive color image by a light-sensitive silver dye bleaching process is described in U.S. Pat. No. 4,235,957.

Recently, a dye transfer method of imagewise releasing or forming a diffusible dye by heat development followed by transferring the diffusible dye to a dye-fixing fixing element has been proposed. In accordance with the method, both a negative color image and a positive color image can be obtained by varying the kind of the dye-donating compound to be used and the kind of the silver halide to be used. The details of the method are described in U.S. Pat. Nos. 4,500,626, 4,483,914, 4,503,137, 4,559,290, JP-A-58-149046, JP-A-60-133449, JP-A-59-218443, JP-A-61-238056, EP-A-220746, Japanese Disclosure Bulletin 87-6199 and EP-A-210660 (the term "JP-A" as used herein means an "unexamined published Japanese patent application").

It has heretofore been difficult to obtain a heat-developable color light-sensitive material which is fogged little when heat-developed and which involves little sensitivity fluctuation relative to the variation of the developing temperature. Examples of using carboxylic acid compounds are described in, for example, JP-A-63-306439 and JP-A-2-251838. However, the light-sensitive materials disclosed in these did not still have satisfactory properties.

SUMMARY OF THE INVENTION

An object of the present invention is to provide a heat-developable color light-sensitive material which is fogged little when heat-developed and which involves little sensitivity fluctuation relative to the variation of the developing temperature.

This and other objects of the present invention have been attained by a heat-developable color light-sensitive material comprising, on a support, a light-sensitive silver halide, a binder, a dye-donating compound and at least one compound represented by formula (I):

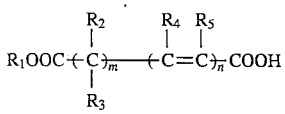

(I)

wherein $R_1$ represents an alkyl group having from 1 to 30 carbon atoms, an alkenyl group having from 2 to 30 carbon atoms, a cycloalkyl group having from 3 to 30 carbon atoms, and an aryl group having from 6 to 36 carbon atoms, which each may be substituted;

$R_2$, $R_3$, $R_4$ and $R_5$ each independently represents a hydrogen atom, an alkyl group having from 1 to 30 carbon atoms, or an alkenyl group having from 2 to 30 carbon atoms;

m represents an integer of from 0 to 10; and n represents 0 or 1;

with the proviso that, when m is an integer of from 1 to 10, n is 0, when n is 1, m is 0;

when m is an integer of from 2 to 10, the plurality of $R_2$ groups may be the same or different, and the plurality of $R_3$ groups may be the same or different;

$R_1$ and $R_2$, $R_2$ and $R_3$, or $R_4$ and $R_5$ each may be bonded to each other to form a ring; and the compound represented by formula (I) has from 10 to 50 total carbon atoms.

As one preferred embodiment of the heat-developable color light-sensitive material of the present invention, the dye-donating compound in the material releases a diffusible dye in correspondence to a silver development.

DETAILED DESCRIPTION OF THE INVENTION

The concrete constitution of the present invention will be described in detail hereunder.

The compounds represented by formula (I) to be employed in the present invention are described in detail.

When $R_1$, $R_2$, $R_3$, $R_4$ or $R_5$ ($R_1$ to $R_5$) in formula (I) is an alkyl group or an alkenyl group or contains an alkyl group moiety or an alkenyl group moiety, the alkyl and alkenyl groups may be either straight or branched or may be substituted.

When $R_1$ in formula (I) is a cycloalkyl group or contains a cycloalkyl group moiety, the cycloalkyl group may be substituted and may also be condensed to form a condensed ring.

When $R_1$ in formula (I) is an aryl group or contains an aryl group moiety, the aryl group may be substituted and may also be condensed to form a condensed ring.

The number of carbon atoms in $R_1$ to $R_5$ in formula (I) as referred to herein means the total carbon number including the carbon atoms in their substituent(s), if any.

In formula (I), $R_1$ represents an alkyl group having from 1 to 30, preferably from 1 to 18, carbon atoms (e.g., methyl, ethyl, propyl, i-propyl, butyl, i-amyl, hexyl, 2-ethylhexyl, nonyl, 3,5,5-trimethylhexyl, i-decyl, dodecyl, i-tridecyl, tetradecyl, hexadecyl, 2-hexyldecyl, i-octadecyl, benzyl, trifluoromethyl, chloromethyl, bromo-ethyl, cyclohexylmethyl, 2-butoxyethyl); an alkenyl group having from 2 to 30, preferably from 2 to 18, carbon atoms (e.g., vinyl, allyl, oleyl, 9-decenyl, 7-octenyl); a cycloalkyl group having from 3 to 30, preferably from 5 to 15, carbon atoms (e.g., cyclopropyl, cyclopentyl, cyclo-hexyl, 4-methylcyclohexyl, 4-t-butylcyclohexyl); or an aryl group having from 6 to 36 carbon atoms (e.g., phenyl, p-(i)-nonylphenyl, p-(t)-octylphenyl). Preferably, $R_1$ is an alkyl group or an alkenyl group, especially preferably an alkyl group.

In formula (I), $R_2$, $R_3$, $R_4$ and $R_5$ each independently represents a hydrogen atom, an alkyl group having from 1 to 30, preferably from 1 to 18, carbon atoms (e.g., those mentioned for $R_1$ hereinabove), or an alkenyl group having from 2 to 30, preferably from 2 to 18, carbon atoms (e.g., those mentioned for $R_1$ hereinabove). Preferably, they are each a hydrogen atom or an alkyl group, and especially preferably a hydrogen atom.

In formula (I), m represents an integer of from 0 to 10, preferably 0, 1, 2, 3, 4 or 8, especially preferably 2 or 3, even more preferably 2. n represents 0 or 1, preferably 0.

When m is an integer of from 1 to 10, n is 0; and when n is 1, m is 0.

When m is an integer of from 2 to 10, the plurality of $R_2$ groups may be the same or different, and the plurality of $R_3$ groups may be the same or different.

$R_1$ and $R_2$, $R_2$ and $R_3$, or $R_4$ and $R_5$ each may be bonded to each other to form a ring.

For instance, $R_2$ may be bonded to $R_3$ to form a cyclohexane ring; and $R_4$ may be bonded to $R_5$ to form a benzene ring.

When m is 2, n is 0, and, preferably, $R_2$ and $R_3$ are each a hydrogen atom, or $R_2$ and $R_3$ are bonded to each other to form a cyclohexane ring. More preferably, $R_2$ and $R_3$ are each a hydrogen atom. In this case, $R_1$ is more preferably an alkyl or alkenyl group having from 10 to 18 carbon atoms.

When m is 3, 4 or 8, n is 0, and, preferably, $R_2$ and $R_3$ are each a hydrogen atom. In this case, $R_1$ is more preferably an alkyl or alkenyl group having from 10 to 18 carbon atoms.

When n is 1, m is 0, and, preferably, $R_4$ and $R_5$ are each a hydrogen atom, or $R_4$ and $R_5$ are bonded to each other to form a benzene ring. More preferably, $R_4$ and $R_5$ are each a hydrogen atom. In this case, $R_1$ is more preferably an alkyl or alkenyl group having from 10 to 18 carbon atoms.

The sum of the carbon atoms in the compound represented by formula (I) is from 10 to 50, preferably from 12 to 30, and more preferably from 14 to 25.

Specific examples of the compounds represented by formula (I) for use in the present invention are mentioned below, which, however, are not limited.

$C_{14}H_{29}OOC(CH_2)_2COOH$ S-1

$C_{12}H_{25}OOC(CH_2)_2COOH$ S-2

$(i\text{-}C_7H_{15})(i\text{-}C_5H_{11})CHCH_2OOC(CH_2)_2COOH$ S-3

$(C_8H_{17})(C_6H_{13})CHCH_2OOC(CH_2)_2COOH$ S-4

$C_{16}H_{33}OOC(CH_2)_2COOH$ S-5

$C_{18}H_{37}OOC(CH_2)_2COOH$ S-6

$(i\text{-}C_9H_{11})(i\text{-}C_7H_{15})CHCH_2OOC(CH_2)_2COOH$ S-7

$C_8H_{17}-CH=CH(CH_2)_8OOC(CH_2)_2COOH$ S-8

-continued

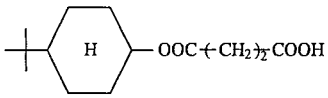
S-9

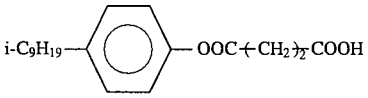
S-10

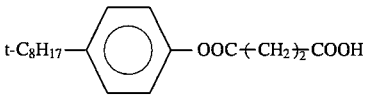
S-11

$C_4H_9O(CH_2)_2OOC(CH_2)_2COOH$ S-12

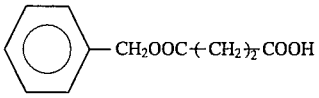
S-13

$C_2H_5OOCCH_2CH(C_{18}H_{37})COOH$ S-14

$CH_2=CHCH_2OOCCH_2CH(C_{18}H_{37})COOH$ S-15

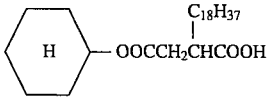
S-16

$C_4H_9OOCCH(C_{18}H_{37})CH_2COOH$ S-17

$C_4H_9CH(C_2H_5)CH_2OOC-CH_2CH(C_{18}H_{37}\text{-}i)COOH$ S-18

$C_{14}H_{29}OOC(CH_2)_3COOH$ S-19

$(C_8H_{17})(C_6H_{13})CHCH_2OOC(CH_2)_3COOH$ S-20

$C_8H_{17}-CH=CH(CH_2)_8OOC(CH_2)_3COOH$ S-21

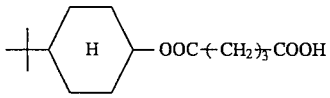
S-22

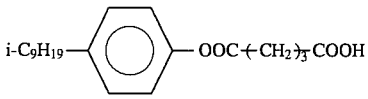
S-23

$C_{14}H_{29}OOC-COOH$ S-24

$C_8H_{17}-CH=CH(CH_2)_8OOC-COOH$ S-25

$C_{14}H_{29}OOCCH_2COOH$ S-26

$C_8H_{17}-CH=CH(CH_2)_8OOCCH_2COOH$ S-27

-continued

S-28

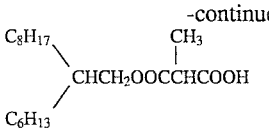

S-29

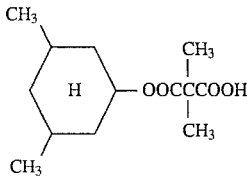

S-30

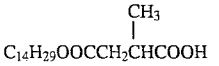

S-31

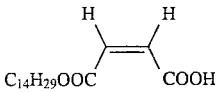

S-32

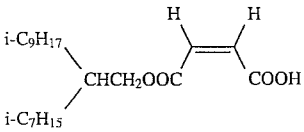

S-33

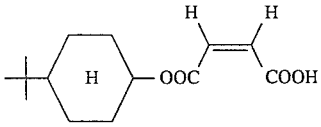

S-34

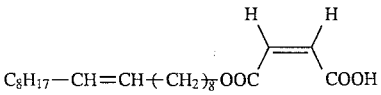

S-35

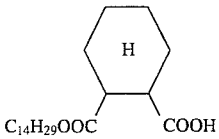

S-36

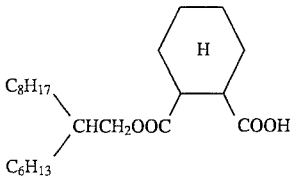

S-37

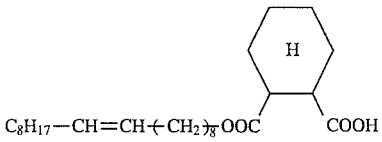

S-38

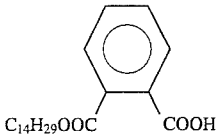

S-39

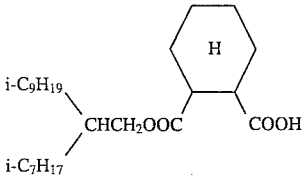

-continued

S-40

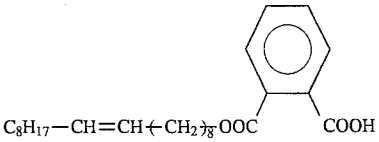

S-41

$C_{14}H_{29}OOC(CH_2)_4COOH$

S-42

$C_8H_{17}-CH=CH(CH_2)_8OOC(CH_2)_4COOH$

S-43

$C_{16}H_{33}OOC(CH_2)_8COOH$

S-44

$i\text{-}C_{13}H_{27}OOC(CH_2)_8COOH$

S-45

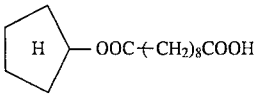

S-46

$CH_2=CH(CH_2)_8OOC(CH_2)_8COOH$

S-47

$(CH_3)_3CCH_2C(CH_3)CH_2CH_2OOC(CH_2)_8COOH$

Example of producing the compound represented by formula (I) for use in the present invention is mentioned below. Production of S-1:

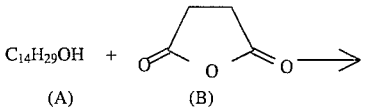

$C_{14}H_{29}OOC(CH_2)_2COOH$

S-1

Alcohol (A) (428.8 g, 2.0 mol) and 242 g (2.4 mol) of succinic anhydride (B) were heated at 120° to 130° C. for 3 hours with stirring. After the resulting mixture was cooled to 80° C., 500 ml of water were added thereto and stirred for 30 minutes. Then, 100 ml of ethyl acetate were added thereto and cooled. After this was subjected to liquid-liquid separation, the thus-separated organic layer was washed twice with water. The organic layer was dried with magnesium sulfate, filtered, concentrated to dryness and crystallized to obtain 625 g of a white solid of S-1. The yield was 99.4%. This had m.p. of 59° C., and its structure was identified by NMR spectrography and MS spectrography.

The compound represented by formula (I) may be incorporated into any layer of the light-sensitive material of the present invention. Preferably, it is added to the layer containing silver halide(s). Especially preferably, it is added to the layer containing the dye-donating compound represented by formula (II) which will be mentioned hereinafter.

The compound represented by formula (I) is added to the light-sensitive material of the present invention in an amount of from 0.01 to 5 mol, preferably from 0.05 to 1 mol, per mol of silver in the material.

The heat-developable light-sensitive material of the present invention basically has, on a support, at least a light-sensitive silver halide emulsion, and a binder. If desired, it may further contain an organic metal salt oxidizing agent and a dye-donating compound (which may be replaced by the reducing agent in the manner as mentioned below).

These components are in most cases incorporated into one and the same layer, but they may be added separately to different layers. For instance, if a colored dye-donating compound is in the layer below a silver halide emulsion layer, it is effective for preventing lowering of the sensitivity of the emulsion layer. A reducing agent is preferably incorporated into a heat-developable light-sensitive material. Alternatively, it may also be supplied to the material from an external source of a dye-fixing material by diffusing it to the light-sensitive material from the dye-fixing material.

In order to obtain colors of a broad range in a chromaticity diagram by using three primary colors of yellow, magenta and cyan, a combination of at least three silver halide emulsion layers each having a light-sensitivity in a different spectral region is used. For instance, usable are a combination of three layers of a blue-sensitive layer, a green-sensitive layer and a red-sensitive layer, a combination of a green-sensitive layer, a red-sensitive layer and an infrared-sensitive layer, and a combination of a red-sensitive layer, an infrared-sensitive layer (I) and an infrared-sensitive layer (II), such as those described in JP-A-59-180550, JP-A-64-13546, JP-A-62-253159, EP-A-479167. The respective light-sensitive layers may be arranged in any desired sequence as generally employed in ordinary color light-sensitive materials. If desired, these light-sensitive layers each may be composed of two or more plural layers each having a different sensitivity degree as described in JP-A-1-252954.

The heat-developable light-sensitive material may have various non-light-sensitive layers, such as protective layer, subbing layer, interlayer, yellow filter layer, and anti-halation layer, between the above-mentioned mentioned silver halide emulsion layers or as the uppermost layer or the lowermost layer. It may also have various auxiliary layers such as backing layer on the side of the support opposite to that coated with the silver halide emulsion layers. Examples of such non-light-sensitive layers and auxiliary layers include the layer constitutions described in the above-mentioned patent publications, the subbing layer described in U.S. Pat. No. 5,051,335, the interlayer containing a solid pigment described in JP-A-1-167838 and JP-A-61-20943, the interlayer containing a reducing agent and a DIR compound described in JP-A-1-120553, JP-A-5-34884 and JP-A-2-64634, the interlayer containing an electron transmitting agent described in U.S. Pat. Nos. 5,017,454, 5,139,919 and JP-A-2-235044, the protective layer containing a reducing agent described in JP-A-4-249245, and combinations of these layers.

It is desirable that the support is designed to have an antistatic function and have a surface resistivity of $10^{12}$ Ω.cm or less.

The silver halide for use in the present invention may be any of silver chloride, silver bromide, silver iodobromide, silver chlorobromide, silver chloroiodide and silver chloroiodobromide.

The silver halide emulsion for use in the present invention may be either a surface latent image type emulsion or an internal latent type emulsion. The latter internal latent type emulsion is used as a direct reversal emulsion, in combination with a nucleating agent or with light fogging. The emulsion may also be a so-called core/shell emulsion in which the inside phase and the surface phase of each grain are different from each other, or an emulsion comprising epitaxial grains grown by epitaxial conjugation to have different silver halides. The silver halide emulsion may be either a monodispersed one or a polydispersed one. To prepare the emulsion, preferably employed is a method of blending plural monodispersed emulsions so as to adjust the gradation of the emulsion mix, such as described in JP-A-1-167743, JP-A-4-223463. The grain size of emulsion grains may be from 0.1 to 2 μm, especially preferably from 0.2 to 1.5 μm. Regarding the crystal habit of silver halide grains, the grains may be regular crystalline ones such as cubic, octahedral or tetradecahedral ones, or irregular crystalline ones such as spherical ones or tabular ones having a high aspect ratio, or twin-crystalline ones having crystal defects, or composite ones composed of such grains.

Concretely, usable in the present invention are all silver halide emulsions prepared by the methods described in, for example, U.S. Pat. Nos. 4,500,626 (column 50), 4,628,021; RD No. 17029 (1978), RD No. 17643 (December, 1978), pages 22 and 23, RD No. 18716 (November, 1979), page 648, RD No. 307105 (November, 1989), pages 863 to 865; JP-A-62-253159, JP-A-64-13546, JP-A-2-236546, JP-A-3-110555; P. Glafkides, *Chemie et Phisique Photographique* (Paul Montel, 1967); G. F. Duffin, *Photographic Emulsion Chemistry* (Focal Press, 1966); V. L. Zelikman et al., *Making and Coating Photographic Emulsion* (Focal Press, 1964).

The light-sensitive silver halide emulsions for use in the present invention are preferably de-salted so as to remove the excess salts therefrom. For the de-salting, for example, employable are a noodle-washing method where gelatin is gelled and a flocculation method using polyanionic inorganic salts (e.g., sodium sulfate), anionic surfactants, anionic polymers (e.g., sodium poly-styrenesulfonate) or gelatin derivatives (e.g., aliphatic acylated gelatins, aromatic acylated gelatins, aromatic carbamoylated gelatins). Preferred is the flocculation method.

The light-sensitive silver halide emulsions for use in the present invention may contain heavy metals, such as iridium, rhodium, platinum, cadmium, zinc, thallium, lead, iron, and osmium, for various purposes. Compounds of such heavy metals may be added to the emulsions singly or as a mixture of two or more of them. The amount of the compounds to be added varies, depending on the object, and is, in general, approximately from $10^{-9}$ to $10^{-3}$ mol per mol of the silver halide in the emulsion. The compounds may be incorporated uniformly into the silver halide grains or locally into or onto the insides or the surfaces of the grains. Concretely, preferred are the emulsions described in JP-A-2-236542, JP-A-1-116637 and JP-A-5-181246.

At the stage of forming the grains of the light-sensitive silver halide emulsions for use in the present invention, it is possible, if desired, to add to the grains, as a silver halide solvent, rhodanates, ammonia or 4-substituted thioether compounds, as well as organic thioether derivatives such as described in JP-B-47-11386 (the term "JP-B" as used herein means an "examined Japanese patent publication"), or sulfur-containing compounds such as described in JP-A-53-144319.

For other conditions in preparing the silver halide emulsions for use in the present invention, referred to are the disclosures in the above-mentioned, Glafkides, *Chemie et Phisique Photographique* (Paul Montel, 1967); G. F. Duffin, *Photographic Emulsion Chemistry* (Focal Press, 1966); and V. L. Zelikman et al., *Making and Coating Photographic Emulsion* (Focal Press, 1964). For instance, employable is any of an acid method, a neutral method and an ammonia method. As the system of reacting soluble silver salts and soluble halides, employable is any of a single jet method, a double jet method and a combination of these. To obtain monodispersed emulsions, preferably employed is a double jet method.

A reversed mixing method may also be employed so as to form silver halide grains in the presence of excess silver ions. As one system of a double jet method, employable is a so-called, controlled double jet method where the pAg value in the liquid phase to give silver halide grains is kept constant.

To accelerate the growth of grains, the concentrations, the amounts and the addition speeds of silver salts and halides to be added may be increased as described in, for example, JP-A-55-142329, JP-A-55-158124, and U.S. Pat. No. 3,650,757.

To stir the reaction system for forming silver halide grains, any known stirring method may be employed. The temperature and the pH value of the reaction system may be determined at any desired ones during the formation of silver halide grains, in accordance with the object. Preferably, the pH value of the system is from 2.2 to 8.5, more preferably from 2.5 to 7.5.

The light-sensitive silver halide emulsions for use in the present invention are, in general, chemically sensitized. To chemically sensitize the emulsions, any of chalcogen sensitization such as sulfur sensitization, selenium sensitization and tellurium sensitization, noble metal sensitization using gold, platinum or palladium, and reduction sensitization, which are known to be employable for sensitizing ordinary light-sensitive emulsions, can be employed singly or as a combination of them. For the chemical sensitization, for example, the disclosures in JP-A-3-110555 and JP-A-5-241267 are referred to. The chemical sensitization may be carried out in the presence of nitrogen-containing heterocyclic compounds as described in JP-A-62-253159. In addition, an antifoggant which will be mentioned hereinafter can be added to the chemically-sensitized emulsions. For instance, employable are the methods described in JP-A-5-45833, JP-A-62-40446.

During the chemical sensitization, the pH value of the emulsion to be sensitized is preferably from 5.3 to 10.5, more preferably from 5.5 to 8.5, and the pAg value thereof is preferably from 6.0 to 10.5, more preferably from 6.8 to 9.0.

In the light-sensitive material of the present invention, the amount of the light-sensitive silver halide emulsions to be coated is from 1 mg/m$^2$ to 10 g/m$^2$ in terms of silver therein.

The light-sensitive silver halide emulsions for use in the present invention may be color-sensitized with, for example, methine dyes, by which the silver halide grains therein are made green-sensitive, red-sensitive or infrared-sensitive. In addition, the blue-sensitive emulsion may also be color-sensitized to make it sensitive to blue light, if necessary.

Examples of the dyes for this purpose include cyanine dyes, merocyanine dyes, complex cyanine dyes, complex merocyanine dyes, holopolar cyanine dyes, hemicyanine dyes, styryl dyes and hemioxonol dyes.

Concretely mentioned are sensitizing dyes described in U.S. Pat. No. 4,617,257, JP-A-59-180550, JP-A-64-13546, JP-A-5-45828, JP-A-5-45834.

These sensitizing dyes may be used singly or as a combination of them. The combination of plural sensitizing dyes is often used for the purpose of super-color sensitization or of controlling the wavelength range for color sensitization.

Dyes which do not have a color-sensitizing activity by themselves or compounds which do not substantially absorb visible rays but which show a super-color sensitizing activity may be incorporated into emulsions along with sensitizing dyes. Examples of such dyes or compounds are described in U.S. Pat. No. 3,615,641 and JP-A-63-23145.

The time of adding such sensitizing dyes into emulsions may be before or after chemical ripening of emulsions. As the case may be, it may be before or after formation of nuclei of silver halide grains, in accordance with U.S. Pat. Nos. 4,183,756 and 4,225,666. These dyes and super-color sensitizers can be added to emulsions as their solutions in organic solvents such as methanol, their dispersions in gelatin or their solutions containing surfactants. Their amounts to be added may be from $10^{-8}$ to $10^{-2}$ mol per mol of the silver halide in the emulsion.

Additives usable in these steps as well as other known light-sensitive additives usable in preparing the heat-developable light-sensitive material of the present invention and dye-fixing (image-receiving) materials are described in the above-mentioned RD Nos. 17643, 18716 and 307105, and the relevant parts in these RDs are mentioned below.

| Additive | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | | ditto | |
| 3. Spectral Sensitizer, Supersensitizer | pp. 23–24 | p. 648, RC to p. 649, RC | pp. 866–868 |
| 4. Brightening Agent | p. 24 | p. 648, RC | p. 868 |
| 5. Antifoggant, Stabilizer | pp. 24–25 | p. 649, RC | pp. 868–870 |
| 6. Light Absorbent, Filter Dye, Ultraviolet Absorbent | pp. 25–26 | p. 649, RC to P. 650, left column (LC) | p. 873 |
| 7. Dye Image Stabilizer | p. 25 | p. 650, LC | p. 872 |
| 8. Hardening Agent | p. 26 | p. 651, LC | pp. 874–875 |
| 9. Binder | p. 26 | ditto | pp. 873–874 |
| 10. Plasticizer, Lubricant | p. 27 | P. 650, RC | p. 876 |
| 11. Coating Aid, Surface Active Agent | pp. 26–27 | ditto | p. 875–876 |
| 12. Antistatic Agent | p. 27 | ditto | pp. 876–877 |
| 13. Matting Agent | | | pp. 878–879 |

As the binder to be used in the layers of constituting heat-developable light-sensitive materials and dye-fixing materials, hydrophilic substances are preferably used. Examples thereof are described in the above-mentioned Research Disclosures and JP-A-64-13546, pages 71 to 75. Concretely, transparent or semi-transparent hydrophilic binders are preferred. Specific examples thereof include natural compounds, such as proteins (e.g., gelatin, gelatin derivatives), and poly-saccharides (e.g., cellulose derivatives, starch, gum arabic, dextran, pullulane); and synthetic polymer compounds (e.g., polyvinyl alcohol, polyvinyl pyrrolidone, acrylamide polymers). In addition, highly water-absorbing polymers described in U.S. Pat. No. 4,960,681 and JP-A-62-245260, such as homopolymers of vinyl monomers having —COOM or —$SO_3M$ (where M is a hydrogen atom or an alkali metal), or copolymers of such vinyl monomers or copolymers of such vinyl monomers along with other vinyl monomers (e.g., sodium methacrylate, ammonium methacrylate, Sumikagel L-5H produced by Sumitomo Chemical Company Limited) may also be used. Such binders may be used as a combination of two or more of them. Gelatin may be selected from lime-processed gelatin, acid-processed gelatin and delimed gelatin having a reduced content of calcium, if necessary. A combination of such gelatins is also preferably employed.

When a system of effecting heat development while applying a slight amount of water thereto is employed in carrying out the present invention, the light-sensitive material of the present invention is desired to contain the high water-absorbing polymer. This is because the material containing such a high water-absorbing polymer can absorb water rapidly. It is also preferred to incorporate the high water-absorbing polymer into the dye-fixing layer and the protective layer therefor. This is because the dye transferred to the dye-fixing material containing such a high water-absorbing polymer in the dye-fixing layer is prevented from being again transferred to other materials.

In the light-sensitive material of the present invention, the amount of the binder to be coated is preferably 20 g or less, more preferably 10 g or less, and especially preferably from 0.5 g to 7 g, per $m^2$ of the material.

In the present invention, an organic metal salt may be used as an oxidizing agent with the light-sensitive silver halide emulsion. Of such organic metal salts, especially preferred are organic silver salts.

Examples of the organic compounds used for forming such organic silver salt oxidizing agents include benzotriazoles, fatty acids and other compounds described in U.S. Pat. No. 4,500,626 (columns 52 and 53). In addition, acetylene silver described in U.S. Pat. No. 4,775,613 is also useful. Two or more kinds of organic silver salts may be employed in combination.

The above-mentioned organic silver salt may be added to the emulsion in an amount of from 0.01 to 10 mols, preferably from 0.01 to 1 mol, per mol of the light-sensitive silver halide. The total amount of the light-sensitive silver halide emulsion and the organic silver salt coated is from 0.05 to 10 g/$m^2$, more preferably from 0.1 to 0.4 g/$m^2$, in terms of silver.

As the reducing agent for use in the present invention, any one which is known in the field of heat-developable light-sensitive materials can be employed. Such agent also includes dye-donating compounds having a reducing property, which will be mentioned hereafter. In this case, another reducing agent(s) can be used, if desired, in combination with such a reducing dye-donating compound. In addition, reducing agent precursors which do not have a reducing property by themselves but which show a reducing capacity with the aid of a nucleating reagent or under heat during the step of development may also be employed.

Examples of the reducing agents used in the present invention include reducing agents and reducing agent precursors as described in U.S. Pat. Nos. 4,500,626 (columns 49 and 50), 4,483,914 (columns 30 and 31), 4,330,617 and 4,590,152, JP-A-60-140355 (pages 17 and 18), JP-A-57-40245, JP-A-56-138736, JP-A-59-178458, JP-A-59-53831, JP-A-59-182449, JP-A-59-182450, JP-A-60-119555, JP-A-60-128436 through JP-A-60-128439, JP-A-60-198540, JP-A-60-181742, JP-A-61-259253, JP-A-62-244044 and JP-A-62-131253, JP-A-62-131256, JP-A-63-10151, JP-A-64-13546 (pages 40 to 57), JP-A-1-120553, JP-A-2-32338, JP-A-2-35451, JP-A-2-234158, JP-A-3-160443 and EP-A-220746 (pages 78 to 96) can be used.

Combinations of various reducing agents described in U.S. Pat. No. 3,039,869 can also be employed.

When non-diffusible reducing agents are used in accordance with the present invention, an electron-transferring agent and/or an electron-transferring agent precursor can be used, if desired, in combination with such a reducing agent for the purpose of accelerating the movement of electrons between the non-diffusible reducing agent and the heat-developable silver halide. Those described in U.S. Pat. No. 5,139,919, EP-A-418743, JP-A-1-138556 and JP-A-3-102345 are especially preferred. In addition, the method in which these agents are stably incorporated as described in JP-A-2-230143 and JP-A-2-235044 are preferred.

The electron-transferring agent or precursor thereof can be selected from the above-mentioned reducing agents and precursors thereof. The electron-transferring agent or precursor thereof is desired to have a higher mobility than the non-diffusible reducing agent (electron donor). Especially useful electron-transferring agents are 1-phenyl-3-pyrazolidones and aminophenols.

The non-diffusible reducing agent (electron donor) employed in combination with the electron-transferring agent may be any one of the above-mentioned reducing agents which are substantially immobile in the layers of a light-sensitive material. Preferably, there can be mentioned hydroquinones, sulfonamidophenols, sulfonamido-naphthols and the compounds described in JP-A-53-110827, U.S. Pat. Nos. 5,032,487, 5,026,634 and 4,839,272 as electron donors, as well as non-diffusible and reducing dye-donating compounds which will later be mentioned.

Further, an electron donor precursor as described in JP-A-3-160443 may be preferably used.

Moreover, the interlayer and protective layer may comprise the foregoing reducing agents incorporated therein for various purposes such as prevention of color mixing, improvement in color reproducibility, improvement in the properties of white background and prevention of silver migration to the dye-fixing material. Specifically, reducing agents as disclosed in EP-A-524649, EP-A-357040, JP-A-4-249245, JP-A-2-64633, JP-A-2-46450, and JP-A-63-186240 are preferably used. Further, development inhibitor-releasing reducing compounds as described in JP-B-3-63733, JP-A-1-150135, JP-A-2-110557, JP-A-2-64634, JP-A-3-43735, and EP-A-451833 may be used.

In accordance with the present invention, the total amount of the reducing agent is from 0.01 to 20 mol, especially preferably from 0.1 to 10 mol, per mol of silver.

In the present invention, silver can be used as an image forming material. When a silver ion is reduced to silver in high temperatures, a compound which can form or release a mobile dye in correspondence or reverse correspondence with the reaction of reducing silver ion into silver as an image-formable substance under high temperature conditions, namely a dye-donating compound, may be combined.

Examples of the dye-donating compounds employed in the present invention include compounds (couplers) capable of forming a dye by an oxidation-coupling reaction. The coupler may be either 4-equivalent couplers or 2-equivalent couplers. 2-Equivalent couplers which have a non-diffusible group as the releasing group and which form a diffusible dye by an oxidation-coupling reaction are preferred. The non-diffusible group may be in the form of a polymer chain. Examples of color developing agents and couplers for use in the present invention are described in detail in T. H. James, *The Theory of the Photographic Process*, 4th Ed., pages 291 to 334 and 354 to 361 and in JP-A-58-123533, JP-A-58-149046, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

A further example of the dye-donating compound includes a compound adapted to imagewise release or spread a diffusible dye. Compounds of such type can be represented by the formula (LI):

$$((\text{Dye}')_r\text{—W})_s\text{—Z} \qquad \text{(LI)}$$

wherein Dye' represents a dye group or dye precursor group whose wavelength has been temporarily shortened;

W represents a single bond or a linkage group;

Z represents a group which causes a differential in the diffusibility of the compound represented by $((Dye')_r—W)_s—Z$ or a group which releases $(Dye')_r—W$ and causes a differential in diffusibility between released $(Dye')_r—W$ and $((Dye')_r—W)_s—Z$, each in correspondence or reverse correspondence with photosensitive silver halide imagewise having a latent image;

r represents an integer of 1 to 5; and s represents 1 or 2;

with the proviso that, when either of r and s is not 1, the plurality of Dye' groups may be the same or different.

Specific examples of the dye-donating compounds of represented by formula (LI) include the following compounds (1) through (5) are mentioned. Compounds (1) through (3) form a diffusible color image (positive color image) in reverse correspondence with the development of silver halide and compounds (4) and (5) form a diffusible color image (negative color image) in correspondence with the development of silver halide.

(1) Dye developers comprising a combination of a hydroquinone developing agent and a dye component, as described in U.S. Pat. Nos. 3,134,764, 3,362,819, 3,597,200, 3,544,545, 3,482,972 and JP-B-3-68387. The dye developers are diffusible under alkaline conditions but become non-diffusible after reaction with silver halide.

(2) Non-diffusible compounds which release a diffusible dye under alkaline conditions but which lose such capacity when reacted with silver halide can also be used, as described in U.S. Pat. No. 4,503,137. As examples of such compounds, there can be mentioned compounds which release a diffusible dye by an intramolecular nucleophilic substitution reaction, as described in U.S. Pat. No. 3,980,479; and compounds which release a diffusible dye by an intramolecular rearrangement reaction of the isoxazol-one one ring in their molecule, as described in U.S. Pat. No. 4,199,354.

(3) Non-diffusible compounds capable of reacting with a reducing agent which remains without being oxidized after development to release a diffusible dye can also be used, as described in U.S. Pat. No. 4,559,290, EP-A-220746, U.S. Pat. No. 4,783,396, Japanese Disclosure Bulletin 87-6199 and JP-A-64-13546.

Examples of such compounds include compounds which release a diffusible dye by an intramolecular nucleophilic substitution reaction after reduction, as described in U.S. Pat. No. 4,139,389 and 4,139,379 and JP-A-59-185333 and JP-A-57-84453; compounds which release a diffusible dye by an intramolecular electron-transfer reaction after reduction, as described in U.S. Pat. No. 4,232,107, JP-A-59-101649 and JP-A-61-88257 and RD No. 24025 (April, 1984); compounds which release a diffusible dye by cleavage of a single bond after reduction, as described in DE-A-3008588, JP-A-56-142530 and U.S. Pat. Nos. 4,343,893 and 4,619,884; nitro compounds which release a diffusible dye after electron reception, as described in U.S. Pat. No. 4,450,223; and compounds which release a diffusible dye after electron reception, as described in U.S. Pat. No. 4,609,610.

More preferably, they include compounds having an $N-X_1$ bond (in which $X_1$ is an oxygen, sulfur or nitrogen atom) and an electron-attracting group in one molecule, as described in EP-A-220746, Japanese Disclosure Bulletin 87-6199, U.S. Pat. No. 4,783,396, and JP-A-63-201653, JP-A-63-201654 and JP-A-64-13546; compounds having an $SO_2-X_1$ groups (in which $X_1$ has the same meaning as mentioned above) and an electron-attracting group in one molecule, as described in JP-A-1-26842; compounds having a $PO-X_1$ bond (in which $X_1$ has the same meaning as mentioned above) and an electron-attracting group in one molecule, as described in JP-A-63-271341; compounds having a $C-X_2$ bond (in which $X_2$ has the same meaning as $X_1$ mentioned above or represents $—SO_2—$) and an electron-attracting group in one molecule, as described in JP-A-63-271341; and compounds which undergo cleavage of a single bond after reduction by $\pi$ bond conjugated with an electron accepting group to release a diffusive dye, as described in JP-A-1-161237 and JP-A-1-161342.

Above all, especially preferred are compounds having an $N-X_1$ bond and an electron-attracting group in one molecule. Specific examples of such compounds include Compounds (1) to (3), (7) to (10), (12), (13), (15), (23) to (26), (31), (32), (35), (36), (40), (41), (44), (53) to (59), (64) and (70) described in EP-A-220746 or U.S. Pat. No. 4,783,396, Compounds (11) to (23) described in Japanese Disclosure Bulletin 87-6199 and Compounds (1) to (84) described in JP-A-64-13546.

(4) Compounds (DDR couplers) which have a diffusible dye as the releasing group and release the diffusible dye by reaction with an oxidation product of a reducing agent are also useful. Examples of such compounds are described in British Patent 1,330,524, JP-B-48-39165 and U.S. Pat. Nos. 3,443,940, 4,474,867 and 4,483,914.

(5) Compounds (DRR compounds) which have the property of reducing silver halides and organic silver salts and which release a diffusible dye after having reduced the halides or salts can also be used. As the compounds of this type can function even in the absence of any other reducing agent, they are advantageously free of the problem of staining of images by the oxidized and decomposed product of a reducing agent. Specific examples of these compounds are described in U.S. Pat. Nos. 3,928,312, 4,053,312, 4,055,428 and 4,336,322, JP-A-56-65839, JP-A-59-69839, JP-A-53-3819 and JP-A-51-104343, RD No. 17465 (October, 1978), U.S. Pat. Nos. 3,725,062, 3,728,113 and 3,443,939, JP-A-58-116537 and JP-A-57-179840 and U.S. Pat. No. 4,500,626. As preferred examples of such DRR compounds, the compounds described in the above-mentioned U.S. Pat. No. 4,500,626 at columns 22 to 44 are useful and above all Compounds (1) to (3), (10) to (13), (16) to (19), (28) to (30), (33) to (35), (38) to (40) and (42) to (64) described in U.S. Pat. No. 4,500,626 are preferred. In addition, the compounds described in U.S. Pat. No. 4,639,408 at columns 37 to 39 are also useful.

Dye-donating compounds other than the above-mentioned couplers and the compounds represented by formula (LI) used in the present invention include dye-silver compounds comprising an organic silver salt and a dye bonded to each other (RD of May 1978, pages 54 to 58), azo dyes employable in a heat-developable silver dye bleaching method (U.S. Pat. No. 4,235,957, RD of April 1976, pages 30 to 32) and leuco dyes (U.S. Pat. Nos. 3,985,565 and 4,022,617).

It is preferred that the dye-donating compound to be in the light-sensitive material of the present invention releases a diffusible dye in correspondence to the silver-forming development of the material. In particular, it is preferred that the dye-donating compound is an yellow dye-donating compound represented by the following formula (II):

$$[(\text{Dye})_p\text{—X}]_q\text{—Y} \quad \text{(II)}$$

wherein Dye represents a dye group or a dye precursor group represented by the following formula (III);

Y represents a group having a property of causing the difference in the diffusiveness of the dye component in correspondence to the imagewise reduction of the light-sensitive silver halide having a latent image to silver;

X represents a single bond or a linkage group;

p represents an integer of 1 or more; and q represents 1 or 2;

with the proviso that, when p is 2 or more or when q is 2 or more, the plurality of Dye groups may be the same or different or the plurality of $(\text{Dye})_p$—X groups may be the same or different:

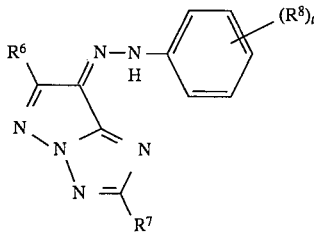

(III)

wherein $R^6$ and $R^7$ each represents a hydrogen atom or a substituent selected from the group consisting of a halogen atom, a hydroxyl group, a cyano group, a nitro group, a carboxyl group, and substituted or unsubstituted alkyl, aralkyl, cycloalkyl, aryl, heterocyclic, alkoxy, aryloxy, amino, acylamino, sulfonylamino, acyl, sulfonyl, carbamoyl, sulfamoyl, ureido, alkylthio and arylthio groups, which each may be substituted by one or more of these substituents;

$R^8$ has the same meaning as $R^6$ and $R^7$, except that $R^8$ cannot represent a hydrogen atom; and t represents an integer of from 0 to 5;

with the proviso that, when t is from 2 to 5, the plurality of $R^8$ groups may be the same or different.

The compound represented by formula (II) used in the present invention will be described in more detail hereunder.

X represents a single bond or a linkage group. Examples of the linkage group represented by X include an alkylene group, a substituted alkylene group, an arylene group, a substituted arylene group, a heterocyclic group, —O—, —$SO_2$—, —CO—, —$NR^{14}$— (in which $R^{14}$ represents a hydrogen atom, an alkyl group, an aryl group, or an aralkyl group), or a combination of two or more of these. When X represents a single bond, it means that there is no atom at the position of X in formula (II).

Preferably, the linking group is —$NR^{14}SO_2$—, —$NR^{14}$CO—, —O—, —$SO_2$—, or a combination of any of these and a substituted or unsubstituted alkylene group (e.g., methylene, ethylene, propylene) and/or a substituted or unsubstituted arylene group (e.g., o-phenylene, m-phenylene, p-phenylene, 1,4-naphthylene).

The linkage group represented by X may be substituted by one or more substituents. Preferred examples of the substituents include an alkyl or aralkyl group, which may be substituted ( e.g., methyl, trifluoromethyl, benzyl, chcloromethyl, dimethylamino-methyl, ethoxycarbonylmethyl, aminomethyl, acetylamino-methyl, ethyl, carboxyethyl, allyl, 3,3,3-trichloropropyl, n-propyl, iso-propyl, n-butyl, iso-butyl, sec-butyl, t-butyl, n-benzyl, sec-pentyl, t-pentyl, cyclopentyl, n-hexyl, sec-hexyl, t-hexyl, cyclohexyl, n-octyl, sec-octyl, t-octyl, n-decyl, n-undecyl, n-dodecyl, n-tetradecyl, n-pentadecyl, n-hexadecyl, sec-hexadecyl, t-hexadecyl, n-octadecyl, t-octadecyl); an alkenyl group, which may be substituted (e.g., vinyl, 2-chlorovinyl, 1-methylvinyl, 2 -cyanovinyl, cyclohexen-1-yl); an alkynyl group, which may be substituted (e.g., ethynyl, 1-propynyl, 2-ethoxy-carbonyl-ethynyl); an aryl group, which may be substituted (e.g., phenyt, naphthyl, 3-hydroxyphenyl, 3-chlorophenyl, 4-acetylaminophenyl, 2-methanesulfonyl-4-nitrophenyl, 3-nitrophenyl, 4-methoxyphenyl, 4-acetylaminophenyl, 4-methanesulfonylphenyl, 2,4-dimethylphenyl); a heterocyclic group, which may be substituted (e.g., 1-imidazolyl, 2 -furyl, 2-pyridyl, 5-nitro-2-pyridyl, 3-pyridyl, 3,5 -dicyano-2-pyridyl, 5-tetrazolyl, 5-phenyl-1-tetrazolyl, 2 -benzothiazolyl, 2-benzimidazolyl, 2-benzoxazolyl, 2 -oxazolin-2-yl, morpholino); an acyl group, which may be substituted (e.g., acetyl, propionyl, butyroyl, iso-butyroyl, 2,2-dimethylpropionyl, benzoyl, 3,4-dichlorobenzoyl, 3-acetylamino-4-methoxybenzoyl, 4-methyl-benzoyl, 4-methoxy-3-sulfobenzoyl); a sulfonyl group, which may be substituted (e.g., methanesulfonyl, ethanesulfonyl, chloromethanesulfonyl, propanesulfonyl, butanesulfonyl, benzenesulfonyl, 4-toluenesulfonyl); a carbamoyl group, which may be substituted (e.g., carbamoyl, methylcarbamoyl, dimethylcarbamoyl, bis-(2-methoxyethyl)carbamoyl, diethylcarbamoyl, cyclohexyl-carbamoyl); a sulfamoyl group, which may be substituted (e.g., sulfamoyl, methylsulfamoyl, dimethylsulfamoyl, diethylsulfamoyl, bis-(2-methoxyethyl)sulfamoyl, di-n-butylsulfamoyl, 3-ethoxypropylmethylsulfamoyl, N-phenyl-N-methylsulfamoyl); an alkoxycarbonyl or aryloxycarbonyl group, which may be substituted (e.g., methoxycarbonyl, ethoxycarbonyl, phenoxycarbonyl, 2-methoxyethoxycarbonyl); an alkoxysulfonyl or aryloxysulfonyl group, which may be substituted (e.g., methoxysulfonyl, ethoxysulfonyl, phenoxysulfonyl, 2-methoxyethoxysylfonyl); an alkoxy or aryloxy group, which may be substituted (e.g., methoxy, ethoxy, methoxyethoxy, 2-chloroethoxy, phenoxy, p-methoxyphenyl); an alkylthio or arylthio group, which may be substituted (e.g., methylthio, ethylthio, n-butylthio, phenylthio, 4-chlorophenylthio, 2-methoxyphenylthio); an amino group, which may be substituted ( e.g., methylamino, N, N-dimethoxyethoxyamino, methylphenylamino); an ammonio group, which may be substituted (e.g. , ammonio, trimethylammonio, phenyldimethylammonio, dimethylbenzyl-ammonio); an acylamino group, which may be substituted (e.g., acetylamino, 2-carboxybenzoylamino, 3-nitrobenzoyl-amino, 3-diethylaminopropanoylamino, acryloylamino); an acyloxy group, which may be substituted (e.g. , acetoxy, benzoyloxy, 2-butenoyloxy, 2-methylpropanoyloxy ); a sulfonylamino group, which may be substituted ( e.g., methanesulfonylamino, benzenesulfonylamino, 2-methoxy-5-n-methylbenzenesulfonylamino); an alkoxycarbonylamino group, which may be substituted (e.g., methoxycarbonylamino, 2-methoxyethoxycarbonylamino, isobutoxycarbonylamino, benzyloxycarbonylamino, t-butoxycarbonylamino, 2-cyanoethoxycarbonylamino); an aryloxycarbonylamino group, which may be substituted (e.g., phenoxycarbonylamino, 2,4-nitrophenoxycarbonylamino); an alkoxycarbonyloxy group, which may be substituted (e.g., methoxycarbonyloxy, t-butoxycarbonyloxy, 2-benzenesulfonylethoxycarbonyloxy, benzylcarbonyloxy); an aryloxycarbonyloxy group, which may be substituted (e.g., phenoxycarbonyloxy, 3-cyanophenoxy-carbonyloxy, 4-acetoxyphenoxycarbonyloxy, 4-t-butoxy-carbonylaminophenoxycarbonyloxy); an aminocarbonylamino group, which may be substituted (e.g., methylamino-carbonylamino, morpholinocarbonylamino, N-ethyl-N-phenyl-aminocarbonylamino, 4-methanesulfonylaminocarbonylamino); an aminocarbonyloxy group, which may be substituted (e.g., dimethylaminocarbonyloxy, pyrrolidinocarbonyloxy, 4-dipropylaminophenylaminocarbonyloxy); an aminosulfonyl-amino group, which may be substituted (e.g., diethylamino-sulfonylamino, di-n-butylaminosulfonylamino, phenylamino-sulfonylamino); a sulfonyloxy group, which may be substituted (e.g., phenylsulfonyloxy, methanesulfonyloxy, chloromethanesulfonyloxy, 4-chlorophenylsulfonyloxy); a carboxyl group; a sulfo group; a cyano group; a nitro group; a hydroxyl group; and a halogen atom.

Of these, especially preferred are an alkoxy group, an amino group, a sulfamoyl group, a sulfonylamino group, a carboxyl group, a sulfo group and a halogen atom.

Y in formula (II) is described in more detail hereunder. The following formulae for Y are expressed to include the moiety of X.

As Y, first mentioned is a negative-working releaser that releases a photographically-useful group in correspondence to development.

As Y which belongs to the group of negative-working releasers, known are releasers that release photographically-useful group from oxidation products.

Preferred examples of Y of this type include residues represented by the following formula (Y-1):

(Y-1)

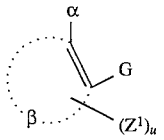

wherein β represents a non-metallic atomic group necessary for forming a benzene ring, which may optionally be condensed with a saturated or unsaturated carbon or hereto ring;

α represents —$OZ^2$ or —$NHZ^3$ in which $Z^2$ represents a hydrogen atom or a group that gives a hydroxyl group by hydrolysis; $Z^3$ represents a hydrogen atom, an alkyl group, an aryl group, or a group that gives an amino group by hydrolysis;

$Z^1$ represents an alkyl, aryl, aratkyl, alkoxy, alkylthio, aryloxy, arylthio, acyl, sulfonyl, acylamino, sulfonylamino, carbamoyl, sulfamoyl, ureido, urethane, heterocyclic or cyano group, which each may be substituted, or a halogen atom;

u represents a positive integer; and

G represents —$NHSO_2Z^4$, in which $Z^4$ represents a divalent group;

with the proviso that, when u is 2 or more, the plurality of $Z^1$ groups may be the same or different Of the residues represented by formula (Y-1), preferred are those represented by the following formulae (Y-2) and (Y-3):

(Y-2)

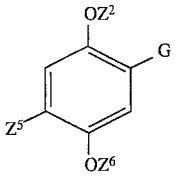

-continued (Y-3)

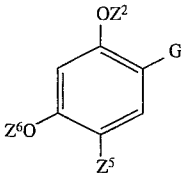

In these formulae, $Z^2$ and G have the same meanings as those in formula (Y-1), respectively; and $Z^5$ and $Z^6$ each represents an alkyl group, an aryl group or an aralkyl group, which each may be substituted.

Preferably, $Z^5$ is a secondary or tertiary alkyl group, and the sum of the carbon atoms in $Z^5$ and $Z^6$ is from 20 to 50.

Specific examples of these residues are described in U.S. Pat. Nos. 4,055,428 and 4,336,322, JP-A-51-113624, JP-A-51-56-16131, JP-A-51-56-71061, JP-A-51-56-71060, JP-A-51-56-71072, JP-A-51-56-73057, JP-A-51-57-650, JP-A-51-57-4073, JP-A-51-59-60439, JP-B-56-17656, and JP-B-60-25780.

Other examples represented by Y include residues represented by the following formula (Y-4):

(Y-4)

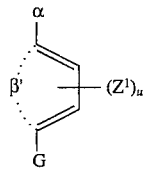

wherein α, G, $Z^1$ and u have the same meanings as those in formula (Y-1), respectively; and β' represents a non-metallic atomic group necessary for forming a benzene ring, which may be condensed with a saturated or unsaturated carbon or hetero ring.

Of the residues represented by formula (Y-4), preferred are those where α is —$OZ^2$ and β' forms a naphthalene structure. Specific examples of these residues are described in U.S. Pat. Nos. 3,928,312 and 4,135,929.

Releasers that release a photographically-useful group by the same reaction as that with the releasers of formulae (Y-1) and (Y-2) are described in JP-A-51-104343, JP-A-53-46730, JP-A-54-130122, JP-A-57-85055, JP-A-53- 3819, JP-A-54-48534, JP-A-49-64436, JP-A-57-20735, JP-B-48-32129, JP-B-48-39165, and U.S. Pat. No. 3,443,934.

Examples of compounds that release a photographically-useful group from oxidation products by a different reaction mechanism include hydroquinone derivatives represented by the following formulae (Y-5) and (Y-6):

(Y-5)

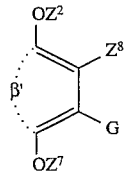

(Y-6)

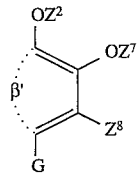

In these formulae, β' has the same meaning as that in formula (Y-4); $Z^7$ has the same meaning as $Z^2$ recited above with regard to formula (Y-1); $Z^8$ has the same meaning as $Z^1$ in formula (Y-I) or represents a hydrogen atom; and $Z^2$ may be the same as or different from $Z^7$. Examples of these compounds are described in U.S. Pat. No. 3,725,062.

Hydroquinone derivative releasers of this kind may have a nucleophilic group in the molecule. Specific examples of such releasers are described in JP-A-4-97347.

Other examples of Y include p-hydroxydiphenylamine derivatives such as those described in U.S. Pat. No. 3,443,939, as well as hydrazine derivatives such as those described in U.S. Pat. Nos. 3,844,785, 4,684,604, and R.D. No. 128, page 22.

Further negative-working releasers for Y are represented by the following formula (Y-7):

Coup-G (Y-7)

wherein Coup represents a group of coupling with oxidation products of p-phenylenediamines or p-aminophenols or, that is, a group known as a residue of a photographic coupler. Specific examples of these releasers are described in British Patent 1,330,524.

Specific examples of yellow dye-donating compounds represented by formula (II) for use in the present invention are mentioned below, which, however, are not limited.

1

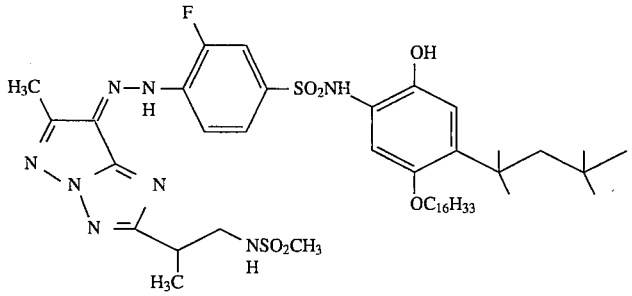

2

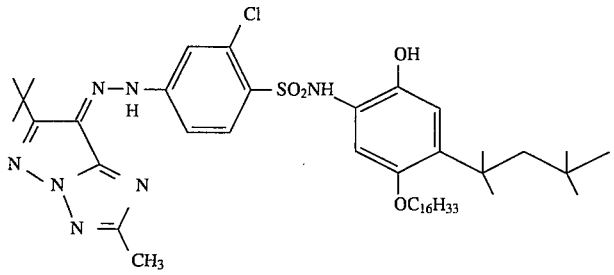

3

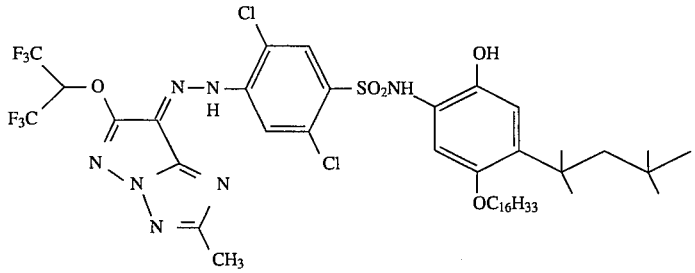

4

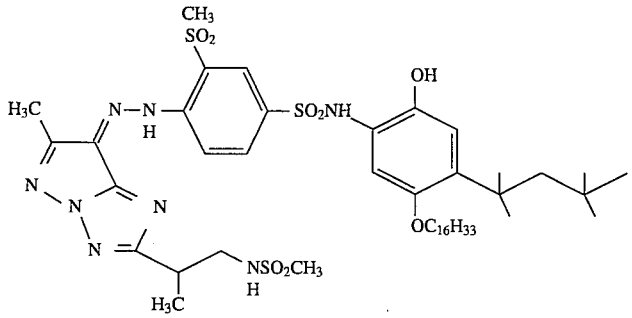

-continued
5
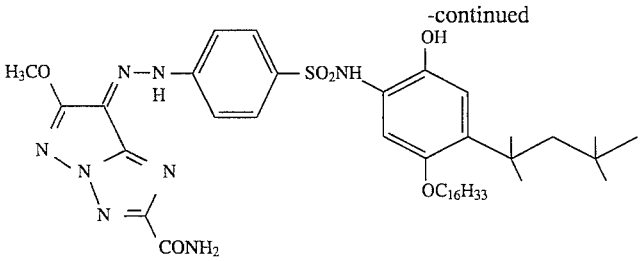
6
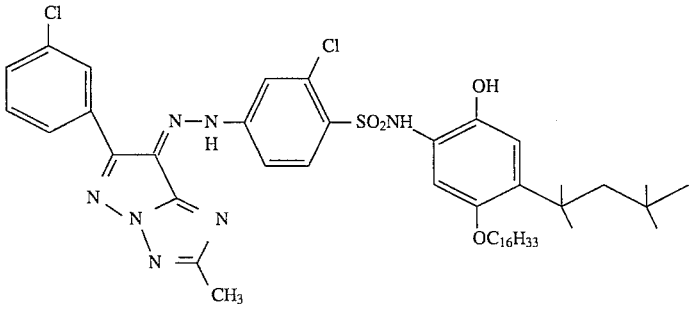
7
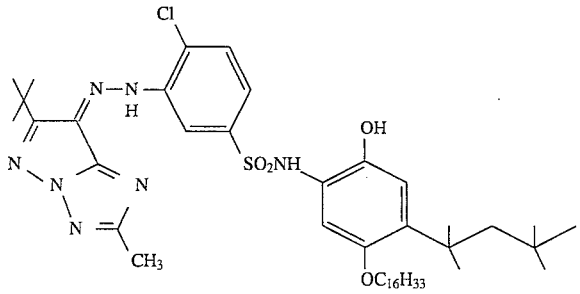
8
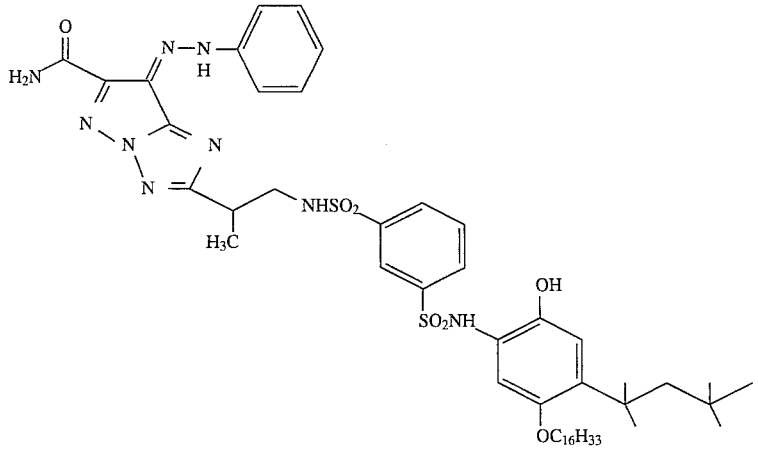
9
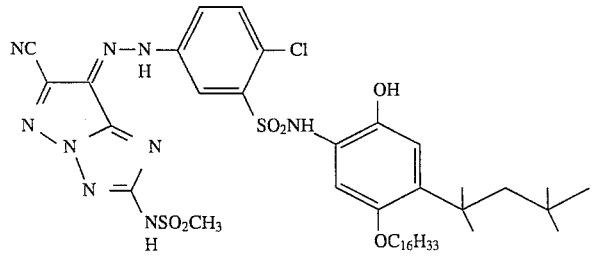

-continued
10
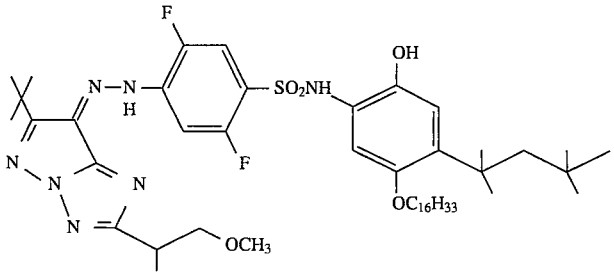
11
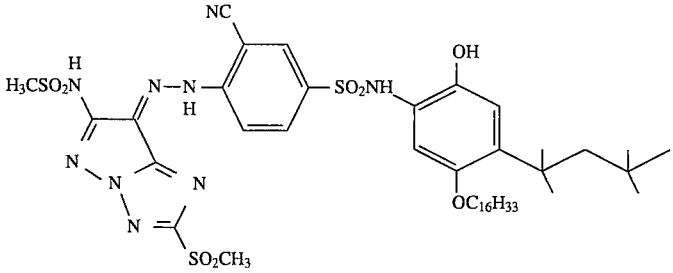
12
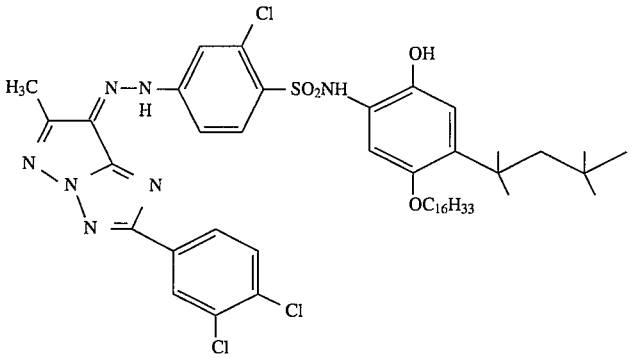
13
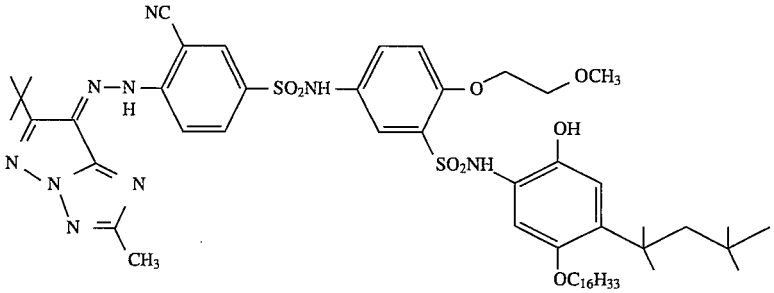

-continued
14
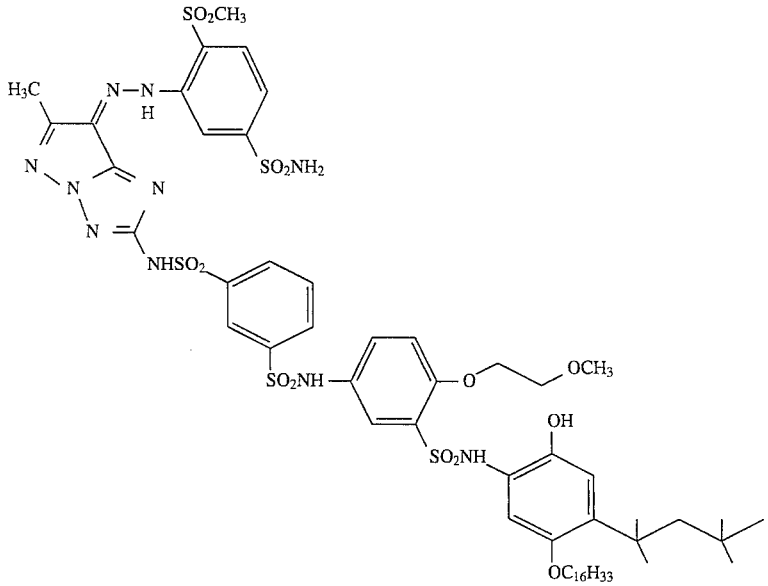
15
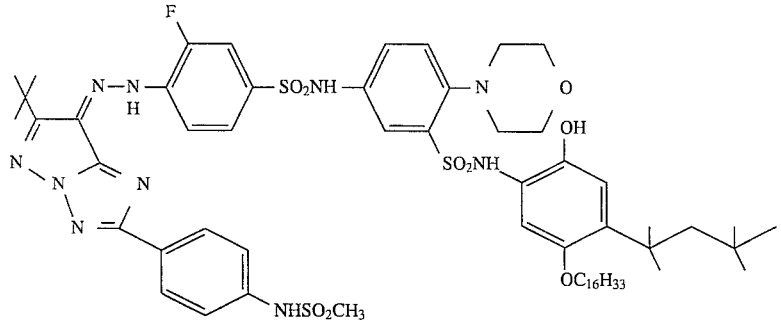
16
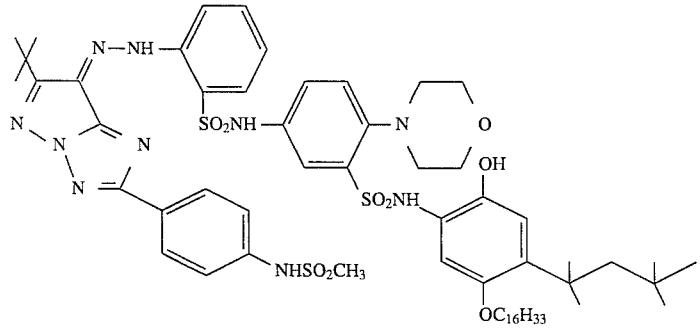

-continued
17
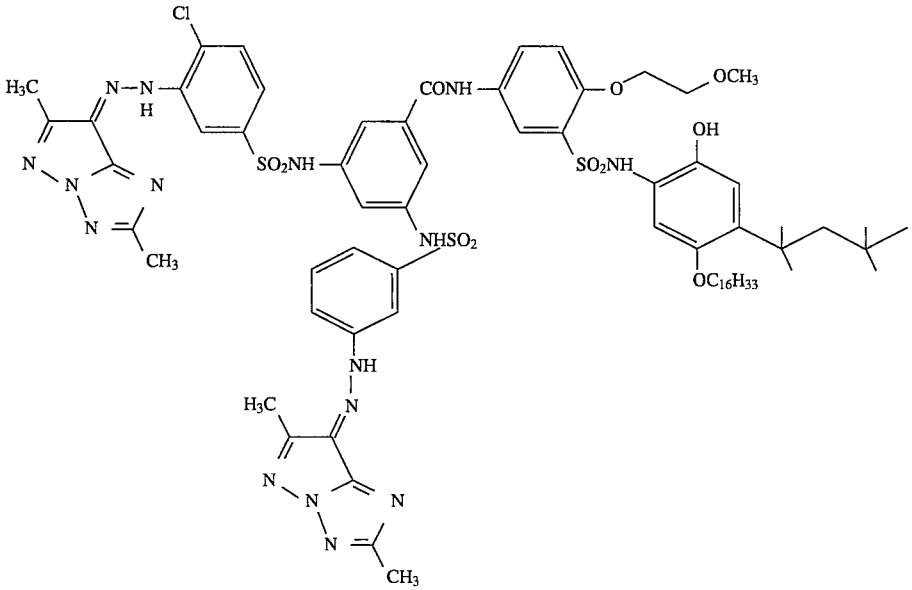
18
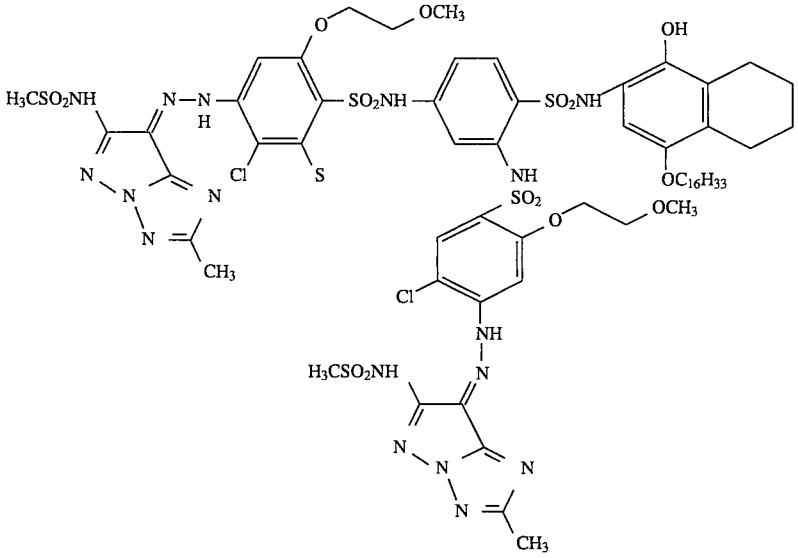
19
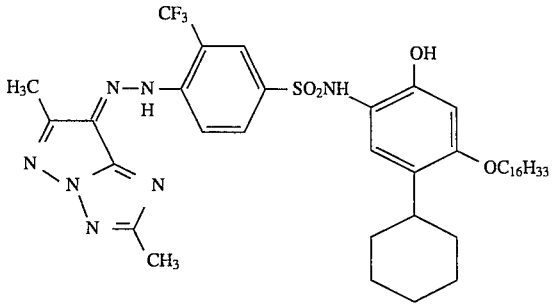

-continued

20

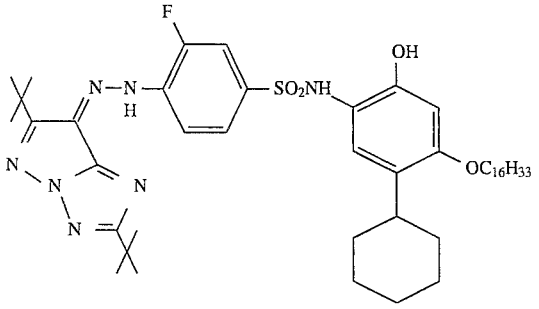

21

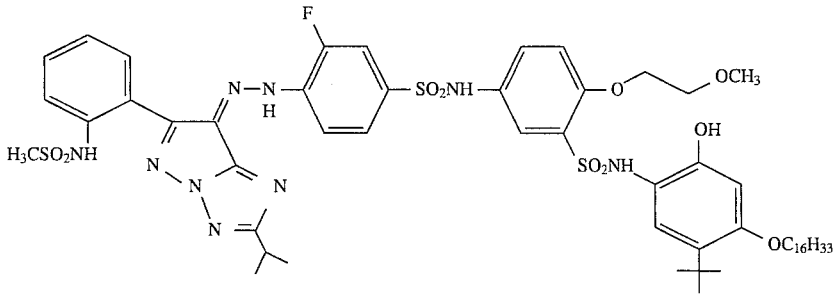

Examples of producing these compounds are described in JP-A-301179 and JP-A-301180.

It is preferred that the compound represented by formula (II) is added to the layer containing silver halide(s) in the light-sensitive material of the present invention. The amount of the compound to be added to the layer may be varied broadly. For example, it may be from 0.01 to 5 mol, preferably from 0.05 to 1 mol, per mol of silver in the material.

Hydrophobic additives such as the dye-donating compound and non-diffusible reducing agent can be incorporated into the layers of the light-sensitive material by any known method, for example, by the method described in U.S. Pat. No. 2,322,027. In this case, high boiling point organic solvents such as those described in JP-A-59-83154, JP-A-59-178451, JP-A-59-178452, JP-A-59-178453, JP-A-59-178454, JP-A-59-178455 and JP-A-59-178457 can be used, optionally together with low boiling point organic solvents having a boiling point of from 50° C. to 160° C. These dye-donating compound, non-diffusible reducing agent, and high and low boiling point organic solvents may be used in combination of two or more thereof.

The amount of the high boiling point organic solvent used is 10 g or less, preferably 5 g or less, and more preferably from 0.1 g to 1 g, per gram of the dye-donating compound used. It is suitably one ml or less, more suitably 0.5 ml or less, especially suitably 0.3 ml or less, per gram of the binder.

In addition, a dispersion method with a polymer, as described in JP-B-51-39853 and JP-A-51-59943, and a method added as fine particle dispersion, as described in JP-A-62-30242, may also be employed.

When a compound to be incorporated into the layers of the heat-developable material of the present invention is substantially insoluble in water, it may be dispersed in the binder in the form of fine grains, in addition to the above-mentioned methods.

When the hydrophobic compound is dispersed in a hydrophilic colloid, various surfactants may be used. For instance, surfactants described in JP-A-59-157636, pages 37 and 38 and the above-described RDs may be used for such purpose.

The light-sensitive material of the present invention can contain a compound having a function of activating the developability thereof and of stabilizing the image formed. Examples of such compounds which can preferably be employed in the present invention are described in U.S. Pat. No. 4,500,626 at columns 51 and 52.

In the system of forming an image by diffusion and transfer of the dye, various compounds may be incorporated in the layers constituting the heat-developable light-sensitive material for the purpose of fixing or making undesirable dyes or colored matters colorless to improve the properties of the white background of the resulting image.

In some detail, compounds described in EP-A-353741, EP-A-461416, JP-A-63-163345 and JP-A-62-203158 may be used.

The layers constituting the heat-developable light-sensitive material according to the present invention can also comprise various pigments or dyes for the purpose of improving color separatability or raising sensitivity.

In some detail, compounds described in the above cited RDs, and compounds and layer structures described in EP-A-479167, EP-A-502508, JP-A-1-167838, JP-A-4-343355, JP-A-2-168252, JP-A-61-20943, EP-A-479167 and EP-A-502508 may be used.

In the system of forming an image by diffusion and transfer of the dye, a dye-fixing material is employed together with the heat-developable light-sensitive material of the present invention. Such systems can be classified into two major categories, a format in which the light-sensitive material and the dye-fixing material are separately disposed on two independent supports and a format in which the two materials are provided as coating layers on one and the same support. As regards the relation between the light-sensitive material and the dye-fixing material, the relation thereof to the support and the relation thereof to a white reflective layer, those described in U.S. Pat. No. 4,500,626 at column 57 are useful in the present invention.

The dye-fixing material which is preferably used in the present invention has at least one layer containing a mordant agent and a binder. As the mordant agent, any one known in the photographic field can be employed, and specific examples thereof include mordant agents described in U.S. Pat. No. 4,500,626 at columns 58 and 59, JP-A-61-88256, pages 32 to 41 and JP-A-1-161236, pages 4 to 7; and those described in U.S. Pat. Nos. 4,774,162, 4,619,883 and 4,594, 308. In addition, dye-receiving high polymer compounds, for example, those described in U.S. Pat. No. 4,463,079 can also be employed.

The hydrophilic binder is preferably used as the binder used in the dye-fixing material according to the present invention. Further, carrageenans described in EP-A-443529, and latexes having a glass transition temperature of 40° C. or less described in JP-B-3-74820 may be preferably used.

The dye-fixing material may optionally have, if desired, auxiliary layers such as a protective layer, a peeling layer, an undercoating layer, an intermediate layer, a backing layer and a curling preventing layer. In particular, provision of a protective layer is helpful.

The layers constituting the heat-developable light-sensitive material and the dye-fixing material of the present invention may contain a plasticizer, a slipping agent as well as a high boiling point organic solvent as an agent for improving peelability between the light-sensitive material and the dye-fixing material. Usable of such materials are those described in JP-A-62-245253.

In addition, for the above-mentioned purposes, various silicone oils (including all silicone oils from dimethylsilicone oil to modified silicone oils formed by introducing various organic groups into dimethylsiloxane) can be used. As examples thereof, usable are various modified silicone oils as described in the technical reference Modified Silicone Oils (published by Shin-Etsu Silicone Co.), page 6-18B. Of them, especially effective is a carboxy-modified silicone (X-22-3710, trade name).

In addition, also effective are the silicone oils described in JP-A-62-215953 and JP-A-63-46449.

The heat-developable light-sensitive material and dye-fixing material can contain an anti-fading agent. Such an anti-fading agent includes an antioxidant, an ultraviolet absorbent as well as various kinds of metal complexes. Further, the dye image stabilizer and ultraviolet absorbent described in the above-described RDs may be used.

Examples of the antioxidant include chroman compounds, coumaran compounds, phenol compounds (e.g., hindered phenols), hydroquinone derivatives, hindered amine derivatives and spiroindane compounds. The compounds described in JP-A-61-159644 are also effective.

Examples of the ultraviolet absorbent include benzotriazole compounds (U.S. Pat. No. 3,533,794), 4-thiazolidone compounds (U.S. Pat. No. 3,352,681), benzophenone compounds (JP-A-46-2784) and other compounds as described in JP-A-54-48535, JP-A-62-136641 and JP-A-61-88256. Further, ultraviolet-absorbing polymers described in JP-A-62-260152 are also effective.

Examples of the metal complexes include compounds described in U.S. Pat. Nos. 4,241,155, 4,245,018 (columns 3 to 36) and 4,254,195 (columns 3 to 8), JP-A-62-174741, JP-A-61-88256 (pages 27 to 29), JP-A-63-199248, JP-A-1-75568 and JP-A-1-74272.

The anti-fading agent for preventing the dye as transferred to the dye-fixing material from fading may previously be incorporated into the dye-fixing material or, alternatively, it may be supplied to the dye-fixing material from an external source such as a light-sensitive material containing the agent.

The above-mentioned antioxidant, ultraviolet absorbent and metal complex can be employed in the present invention in the form of a combination thereof.

The heat-developable light-sensitive material and the dye-fixing material can contain a brightening agent. In particular, it is preferred to incorporate a brightening agent in the dye-fixing element or to supply the same to the said element from an external source such as a light-sensitive element containing the agent. As examples of the agent, compounds as described in K. Veenkataraman, *The Chemistry of Synthetic Dyes*, Vol. V, Chap. 8, and JP-A-61-143752 can be mentioned. Specifically, there can be mentioned stilbene compounds, coumarin compounds, biphenyl compounds, benzoxazolyl compounds, naphthalimide compounds, pyrazoline compounds and carbostyryl compounds.

The brightening agent can be employed in combination with the anti-fading agent or the ultraviolet absorbent.

Examples of the anti-fading agent, the ultraviolet absorbent and the brightening agent are described in JP-A-62-215272, pages 125 to 137 and JP-A-1-161236, pages 17 to 43.

The layers constituting the heat-developable light-sensitive material and the dye-fixing material can contain a hardening agent. Examples thereof are hardening agents described in the above-described RDs, U.S. Pat. Nos. 4,678,739 (column 41), 4,791,042 and JP-A-59-116655, JP-A-62-245261, JP-A-61-18942 and JP-A-4-218044. Specific examples include aldehyde hardening agents (e.g., formaldehyde), aziridine hardening agents, epoxy hardening agents, vinylsulfone hardening agents (e.g., N,N'-ethylene-bis(vinylsulfonylacetamide)ethane), N-methylol hardening agents (e.g., dimethylolurea) and high polymer hardening agents (e.g., compounds described in JP-A-62-234157).

Such a hardening agent is preferably used in an amount of from 0.001 g to 1 g, more preferably 0.005 g to 0.5 g, per one g of gelatin coated. The hardening agent may be incorporated in any of the layers constituting the light-sensitive material or dye-fixing material or may be separately incorporated in two or more layers.

The layers constituting the heat-developable light-sensitive material or dye-fixing material may comprise various fog inhibitors, photographic stabilizers, or precursors thereof. Specific examples of these compounds are described in the above cited RDs, U.S. Pat. Nos. 5,089,378, 4,500,627, 4,614,.702, JP-A-64-13546, pages 7 to 9, pages 57 to 71, pages 81 to 97, U.S. Pat. Nos. 4,775,610, 4,626,500, 4,983,494, JP-A-62-174747, JP-A-62-239148, JP-A-63-264747, JP-A-1-150135, JP-A-2-110557, JP-A-2-178650, and RD 17643 (1978), pages 24 to 25.

These compounds are preferably used in an amount of $5\times10^{-6}$ to $1\times10^{-1}$ mol, more preferably $1\times10^{-5}$ to $1\times10^{-2}$ mol, per mol of silver.

The layers constituting the light-sensitive material and the dye-fixing material of the present invention can contain various surfactants for various purposes of aiding coating, improvement of the peeling property, improvement of the sliding property, prevention of static charge and enhancement of developability. Specific examples of such surfactants are described in JP-A-62-173463 and JP-A-62-183457.

The layers constituting the light-sensitive material and the dye-fixing material of the present invention can contain organic fluorine compounds for the purpose of an improvement of the sliding property, prevention of static charge and improvement of the peeling property. Specific examples of such organic fluorine compounds include fluorine surfactants described in JP-B-57-9053 (columns 8 to 17) and JP-A-61-20944 and JP-A-62-135826, as well as hydrophobic fluorine compounds such as fluorine oils and like oily fluorine compounds and ethylene tetrafluoride resins and like solid fluorine compound resins.

The light-sensitive material and the dye-fixing material can contain a matting agent. Examples of the matting agent include silicon dioxide and compounds described in JP-A-61-88256 (page 29) such as polyolefins or polymethacrylates, as well as compounds described in JP-A-63-274944 and JP-A-63-274952, such as benzoguanamine resin beads, polycarbonate resin beads and AS (acrylo-nitrile-styrene) resin beads. In addition, compounds described in the above-described RDs are used. These matting agents can be added into not only the uppermost layer (protective layer) but also lower layer(s) if necessary.

In addition, the layers constituting the light-sensitive element and the dye-fixing element may further contain a thermal solvent, a defoaming agent, a microbicidal and fungicidal agent, colloidal silica and other additives. Examples of such additives are described in JP-A-61-88256 (pages 26 to 32), JP-A-3-11338 and JP-B-2-51486.

In accordance with the present invention, the heat-developable light-sensitive material and/or the dye-fixing material can contain an image formation accelerator. Useful image formation accelerators include those which promote a redox reaction between a silver salt oxidizing agent and a reducing agent, those which promote the reactions of forming a dye from a dye-donating substance or decomposing a dye or releasing a diffusible dye, and those which promote the migration of a dye from the heat-developable light-sensitive layer to the dye-fixing layer. Classified by physicochemical function, the image formation accelerators can be classified into bases or base precursors, nucleophilic compounds, high boiling point organic solvents (oils), thermal solvents, surfactants and compounds which interact with silver or silver ions, for instance. However, each of these substances generally has plural functions and provides several of the above-mentioned effects. A detailed discussion on these substances can be found in U.S. Pat. No. 4,678,739 at columns 38 to 40.

As the base precursor, there can be mentioned salts between an organic acid which may be decarboxylated under heat and a base, as well as compounds capable of releasing an amine by an intramolecular nucleophilic substitution reaction, Rossen rearrangement or Beckmann rearrangement. Specific examples thereof are described in U.S. Pat. Nos. 4,514,493 and 4,657,848.

In the system where heat-development and dye transfer are effected simultaneously in the presence of a small amount of water, it is preferred to incorporate the base and/or base precursor in the dye-fixing material for the purpose of improving the storage stability of the heat-developable light-sensitive material.

In addition, the combination of a hardly soluble metal compound and a compound capable of complexing with the metal ion which constitutes the hardly soluble metal compound (hereinafter referred to as a "complex-forming compound") described in EP-A-210660, U.S. Pat. No. 4,740,445; as well as compounds yielding a base by electrolysis described in JP-A-61-232451 can also be used as the base precursor. Use of the former is especially effective. The hardly soluble metal compound and the complex-forming compound are advantageously separately added to different heat-developable light-sensitive material and dye-fixing material as described in the above references.

The heat-developable light-sensitive material and/or the dye-fixing material of the present invention can contain various development terminating agents for the purpose of always obtaining constant images despite fluctuations in the development temperature and the processing time for development.

The terminology "development terminating agent" as used herein means a compound which, after proper development, quickly neutralizes a base or reacts with a base to lower the base concentration in the layer in which the base is present and thereby terminates the development, or a compound which interacts with silver or a silver salt to arrest development. Specifically, there can be mentioned acid precursors which release an acid under heat, electrophilic compounds which react with the existing base by a substitution reaction under heat, as well as nitrogen-containing heterocyclic compounds, mercapto compounds and precursors thereof. More precisely, specific examples of these compounds are described in JP-A-62-253159 (pages 31 and 32).

The support which is employed in preparing the heat-developable light-sensitive material and the dye-fixing material of the present invention may be any support that withstands the processing temperature. In general, paper and synthetic high polymer films, such as described in *Bases of Photographic Engineering*, Edition of Silver Photography, pages 223 to 240 (published by Corona Publishing Co., Ltd., Japan, 1979), are used as the support. Specifically, the support includes films of polyethylene terephthalate (PET), polycarbonates, polyvinyl chloride, polystyrene, polypropylene, polyimide, celluloses (e.g., triacetyl cellulose) and those films containing a pigment such as titanium oxide; synthetic paper made of polypropylene by a filming method; mixed paper made of a synthetic resin pulp (e.g., polyethylene) and a natural pulp; as well as Yankee paper, baryta paper, coated paper (especially cast-coated paper), metals, cloth and glass.

These supports may be used directly as they are or may be used in the form as coated with a synthetic high polymer substance (e.g., polyethylene) on one surface or both surfaces thereof. The coated layer may contain pigments or dyes such as titanium oxide, ultramarine and carbon black, if necessary.

In addition, supports described in JP-A-62-253159, pages 29 to 31, JP-A-1-161236, pages 14 to 17, JP-A-63-316848, JP-A-2-22651, JP-A-3-56955 and U.S. Pat. No. 5,001,033 can also be employed in the present invention.

The surface of the support may be coated with a hydrophilic binder and a semiconductive metal oxide (e.g., an alumina sol or tin oxide) or an antistatic agent such as carbon black. Specifically, supports described in JP-A-63-220246 can also be used.

The surface of the support is preferably subjected to various surface treatment or coating treatment in order to improve adhesivity to a hydrophilic binder.

For imagewise exposing and recording an image on the heat-developable light-sensitive material of the present invention, various methods can be employed, which include, for example, a method of directly photographing a scene or man with a camera; a method of exposing an image through a reversal film or negative film by the use of a printer or an enlarger; a method of scanning and exposing an original through a slit by the use of an exposing device of a duplicator; a method of exposing image information via a corresponding electric signal by emitting the same with an emitting diode or various lasers (e.g., laser diode, gas laser) as described in JP-A-2-129625, JP-A-5-176144, JP-A-5-199372 and JP-A-6-127021; and a method of outputting image information with an image display device such as a CRT, liquid crystal display, electroluminescence display or plasma display and then exposing the same directly or via some optical system.

As the light source used for recording an image on the light-sensitive material of the present invention, those as described in U.S. Pat. No. 4,500,626 (column 56), JP-A-2-53378 and JP-A-2-54672, such as natural light, a tungsten lamp, a light-emitting diode, laser rays and CRT rays can be employed, as mentioned above.

Further, a wavelength conversion element in which a nonlinear optical material is combined with a coherent light source such as laser can be used to effect imagewise exposure. The nonlinear optical material is a material capable of developing nonlinearity between polarization and electric field created when a strong photoelectric field such as laser light is given. Inorganic compounds such as lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62-210432. As wavelength conversion elements, single crystal light guide type wavelength conversion element, fiber type wavelength conversion element, and so on have been known. Any of these types of wavelength conversion elements can be effectively used.

As the above-described image information, any image signals obtained from a video camera or electronic still camera; television signals as standardized by the Nippon Television Signal Code (NTSC); image signals obtained by dividing an original into plural pixels with a scanner; and image signals formed by the use of a computer such as CG or CAD, can be employed.

The heat-developable light-sensitive material and/or dye-fixing material according to the present invention may have an electrically conductive heating element layer as a heating means for heat development and diffusion transfer of dye. In this embodiment, heating elements described in JP-A-61-145544 may be used.

The heating temperature in the heat-development step of the present invention may be from about 50° C. to about 250° C. An especially useful temperature is from about 60° C. to about 180° C. The step of diffusing and transferring the dye formed by development may be effected simultaneously with the heat-development step or after the same. In the latter case, the heating temperature in the transfer step may be from the temperature in the previous heat-development step to room temperature. Preferably, it is from 50° C. to a temperature lower than the temperature in the heat-development step by about 10° C.

Migration of the dye formed may be effected only by heat, but a solvent may be used for the purpose of accelerating the migration of the dye. Further, as described in detail in U.S. Pat. Nos. 4,704,345 and 4,740,445 and JP-A-61-238056, a method where development and transfer are carried out in the presence of a small amount of a solvent (especially, water) under heating, either at the same time or in a continuous sequence, can be advantageously utilized. In this method, the heating temperature is preferably from 50° C. to the boiling point of the solvent used. For instance, when the solvent is water, the temperature is desirably from 50° C. to 100° C.

Examples of the solvents used for the acceleration of development and/or transfer of the diffusible dye include water and an aqueous basic solution containing an inorganic alkali metal salt or an organic base. As the bases, those mentioned hereinbefore as image formation accelerators can be employed. In addition, a low boiling point solvent or a mixed solvent comprising a low boiling point solvent and water or an aqueous basic solution can also be used. Further, surfactants, antifoggants, complex-forming compounds with hardly soluble metals, an antiputrefaction agent, and an antimicrobial agent can be incorporated into the solvents.

As the solvent used in these heat-developing and diffusion-transferring steps, water is preferred. As water, any ordinary water may be employed. For example, concretely mentioned are distilled water, city tap water, well water, and mineral water. In the heat-developing device to be used for processing the heat-developable material of the present invention along with dye-fixing material, water once used may be drained off or may be circulated through the device for recycle use. In the latter case, water to be circulated and re-used contains chemicals dissolved out from the processed materials. In addition, devices and water described in JP-A-63-144354, JP-A-63-144355, JP-A-62-38460, and JP-A-3-210555 can also be used in processing the light-sensitive materials of the present invention.

The solvent can be applied to either or both of the heat-developable light-sensitive material and the dye-fixing material. The amount of the solvent to be applied may be equal to or less than the weight of the solvent corresponding to the maximum swollen volume of all the coated layers.

To apply water to the material, for example, preferably employable are methods described in JP-A-62-253159, page 5 and JP-A-63-85544. If desired, the solvent to be applied may be encapsulated in microcapsules or may be incorporated into the heat-developable light-sensitive material and/or the dye-fixing material as its hydrate.

The temperature of water to be applied is from 30° C. to 60° C., as so described in the above-mentioned JP-A-63-85544. In particular, the temperature is preferably 45° C. or higher in order to prevent harmful microbes from growing in water.

In order to accelerate the migration of the dye formed, a system of incorporating a hydrophilic thermal solvent which is solid at room temperature but which can melt at a high temperature into the light-sensitive material or into the dye-fixing material may also be employed in the present invention. In employing this system, the hydrophilic thermal solvent may be incorporated into either the light-sensitive material or the dye-fixing material or into both of them. The layer to which the solvent is added may be any of the light-sensitive silver halide emulsion layer, interlayer, protective layer and dye-fixing layer, but the solvent is preferably added to the dye-fixing layer and/or layer(s) adjacent thereto.

Examples of the thermal solvent to be employed in such a system include ureides, pyridines, amides, sulfonamides, imides, alcohols, oximes and other heterocyclic compounds.

For heating the materials in the development step and/or the transfer step, they may be kept in contact with a heated block or plate, or with a hot plate, hot presser, hot roller, halogen lamp heater or infrared or farinfrared lamp heater or may be passed through a high temperature atmosphere.

When the light-sensitive material is attached to the dye-fixing material, methods described in JP-A-62-253159 and JP-A-61-147244 (page 27) are applicable.

For processing the photographic elements of the present invention, any general heat-developing apparatus can be utilized. For instance, apparatus described in JP-A-59-75247, JP-A-59-177547, JP-A-59-181353 and JP-A-60-18951, JU-A-62-25944, Japanese Patent Application Nos. 4-277517, 4-243072 and 4-244693 are preferably employed (the term "JU-A" as used herein means an "examined Japanese utility application"). Examples of commercially available heat developing apparatus include Pictrostat 100, Pictrostat 200, Pictrography 2000 and Pictrography 3000 produced by Fuji Photo Film Co., Ltd.

The present invention is now illustrated in greater detail by way of the following examples, but it should be understood that the present invention is not to be deemed to be limited thereto.

EXAMPLE 1

Preparation of light-sensitive silver halide emulsions is mentioned below. Light-Sensitive Silver Halide Emulsion (1) (for red-sensitive emulsion layer):

Solution (I) and solution (II) shown in Table 1 below were simultaneously added to a well stirred aqueous gelatin solution (prepared by adding 20 g of gelatin, 0.3 g of potassium bromide, 2 g of sodium chloride and 30 mg of compound (a) shown below to 600 ml of water and kept at 45° C.), over a period of 20 minutes at the same flow rate. After 5 minutes, solution (III) and solution (IV) also shown in Table 1 were simultaneously added thereto over a period of 25 minutes at the same flow rate.

This was rinsed with water and desalted by an ordinary method, and 22 g of lime-processed ossein gelatin and 90 mg of compound (b) shown below were added thereto, and pH of this was adjusted to be 6.2 with pAg thereof to 7.7. Then, this was subjected to optimum chemical sensitization at 60° C. for about 50 minutes, with adding 500 mg of a decomposate of ribonucleic acid and 2 mg of trimethylthiourea thereto. Next, 225 mg of 4-hydroxy-6 -methyl-1,3, 3a,7-tetrazaindene, 64 mg of dye (a) shown below and 500 mg of KBr were added to this in order, which was then cooled. Accordingly, 635 g of a monodispersed emulsion of cubic silver chlorobromide grains having a mean grain size of 0.30 μm were obtained.

TABLE 1

| | Solution (I) | Solution (II) | Solution (III) | Solution (IV) |
|---|---|---|---|---|
| $AgNO_3$ | 30.0 g | — | 70.0 g | — |
| $NH_4NO_3$ | 0.12 g | — | 0.27 g | — |
| KBr | — | 13.7 g | — | 44.0 g |
| NaCl | — | 3.6 g | — | 2.4 g |
| $K_2IrCl_6$ | — | — | — | 0.04 mg |
| | Water to make 150 ml | Water to make 150 ml | Water to make 350 ml | Water to make 350 ml |

Compound (a):

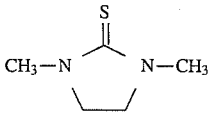

Compound (b):

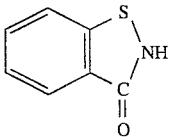

Dye (a):

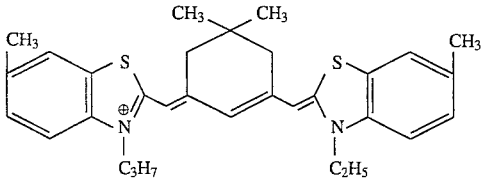

$I^{\ominus}$

Light-Sensitive Silver Halide Emulsion (2) (for green-sensitive emulsion layer):

Solution (I) and solution (II) shown in Table 2 below were simultaneously added to a well stirred aqueous gelatin solution (prepared by adding 20 g of gelatin, 0.3 g of potassium bromide, 2 g of sodium chloride and 30 mg of compound (a) to 600 ml of water and kept at 55° C.), over a period of 10 minutes at the same flow rate. After 5 minutes, solution (III) and solution (IV) also shown in Table 2 were simultaneously added thereto over a period of 30 minutes at the same flow rate. One minute after the finish of the addition of Solution (III) and Solution (IV), 60 ml of a dye-containing methanol solution (containing 360 mg of dye (b) shown below) was added to this all at a time.

This was rinsed with water and desalted by an ordinary method, and 22 g of lime-processed ossein gelatin were added thereto, and pH of this was adjusted to be 6.0 with pAg thereof to 7.6. Then, this was subjected to optimum chemical sensitization at 60° C., with adding 2.4 mg of sodium thiosulfate and 180 mg of 4-hydroxy-6-methyl-1,3, 3a,7-tetrazaindene thereto. Next, 165 mg of antifoggant (2) shown below were added to this, which was then cooled. Accordingly, 635 g of a monodispersed emulsion of cubic silver chlorobromide grains having a mean grain size of 0.45 μm were obtained.

TABLE 2

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.19 g | — | 0.38 g | — |
| KBr | — | 9.80 g | — | 44.80 g |
| NaCl | — | 2.06 g | — | 5.51 g |
| | Water to make 165 ml | Water to make 165 ml | Water to make 205 ml | Water to make 205 ml |

Dye (b):

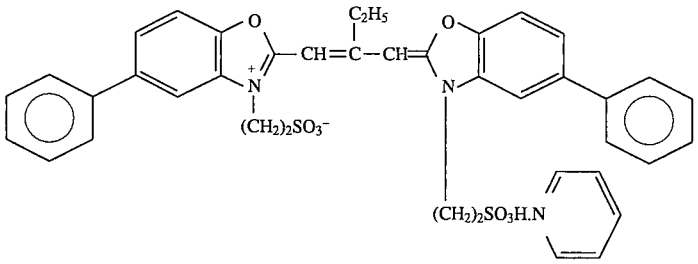

Anti-foggant (2):

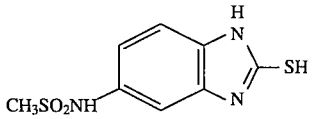

Light-Sensitive Silver Halide Emulsion (3) (for blue-sensitive emulsion layer):

Solution (I) and solution (II) shown in Table 3 below were added to a well stirred aqueous gelatin solution (prepared by adding 20 g of gelatin, 4 g of KBr and 10 mg of compound (a) to 880 ml of water and kept at 75° C.), in such a way that Solution (II) was first added and then Solution (I) was added after 30 seconds, both over a period of 30 minutes. Five minutes after the finish of the addition of Solution (II), Solution (III) was added to this and, 30 seconds after this, Solution (IV) was added thereto, both over a period of 30 seconds.

This was rinsed with water and desalted (at pH of 3.9 by adding 1 g of flocculator (a) shown below thereto) by an ordinary method, and 6 g of lime-processed ossein gelatin and 70 mg of compound (b) were added thereto, whereby pH of this was adjusted to be 6.0 with pAg thereof to 8.3. Then, this was subjected to optimum chemical sensitization at 65° C. for about 60 minutes, with adding 1.2 mg of sodium thiosulfate thereto. Afterwards, 450 mg of dye (c) shown below and 72 mg of antifoggant (3) shown below were added to this in order, which was then cooled. Accordingly, an emulsion of octahedral silver halide grains having a mean grain size of 0.5 μm was obtained.

TABLE 3

| | Solution (I) | Solution (II) | Solution (III) | Solution (IV) |
|---|---|---|---|---|
| $AgNO_3$ | 20 g | — | 90 g | — |
| $NH_4NO_3$ | 0.08 g | — | 0.37 g | — |
| KBr | — | 14.5 g | — | 65.2 g |
| KI | — | — | — | — |
| | Water to make 200 ml | Water to make 200 ml | Water to make 400 ml | Water to make 400 ml |

TABLE 3-continued

| | Solution (I) | Solution (II) | Solution (III) | Solution (IV) |
|---|---|---|---|---|

Dye (c):

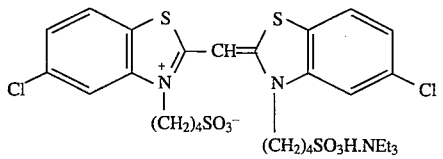

Flocculator (a):

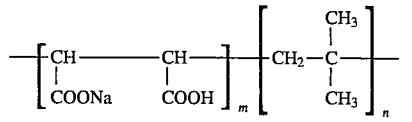

m + n = 1

Anti-foggant (3):

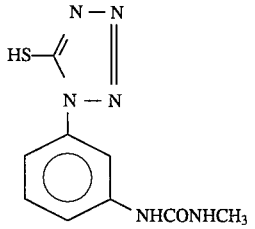

Light-Sensitive Silver Halide Emulsion (4) (for blue-sensitive emulsion layer):

This was prepared in the same manner as in the preparation of light-sensitive silver halide emulsion (3), except that Solution (IV) was replaced by Solution (I) in Table 4 below.

TABLE 4

| | Solution (I) |
|---|---|
| $AgNO_3$ | — |
| $NH_4NO_3$ | — |
| KBr | 63.9 g |
| KI | 1.8 g |
| | water to make 200 ml |

Light-Sensitive Silver Halide Emulsion (5) (for blue-sensitive emulsion layer):

Solution (I) and solution (II) shown in Table 5 below were simultaneously added to a well stirred aqueous gelatin solution (prepared by adding 20 g of gelatin, 0.3 g of KBr, 9 g of sodium chloride and 15 mg of compound (a) to 650 ml of water and kept at 64° C.), over a period of 10 minutes at the same flow rate. After 10 minutes, solution (III) and solution (IV) also shown in Table 5 were simultaneously added thereto over a period of 30 minutes at the same flow rate. One minute after the finish of the addition of solution (III) and solution (IV), an aqueous solution of a dye (containing 360 mg of dye (c) in 72 ml of water) was added thereto all at a time.

This was rinsed with water and desalted by an ordinary method, and 33 g of lime-processed ossein gelatin and 100 mg of compound (b) were added thereto, and pH of this was adjusted to be 6.0 with pAg thereof to 8.6. Then, this was subjected to optimum chemical sensitization at 65° C., with adding 1.0 mg of sodium thiosulfate and 180 mg of 4-hydroxy-6-methyl-1,3,3a,7-tetrazaindene thereto, which was then cooled. Accordingly, an emulsion of cubic silver halide grains having a mean grain size of 0.5 μm was obtained.

TABLE 5

| | Solution (I) | Solution (II) | Solution (III) | Solution (IV) |
|---|---|---|---|---|
| $AgNO_3$ | 25 g | — | 75 g | — |
| $NH_4NO_3$ | 0.13 g | — | 0.38 g | — |
| KBr | — | 12.3 g | — | 42 g |
| NaCl | — | 2.6 g | — | 5.2 g |
| | Water to make 120 ml | Water to make 120 ml | Water to make 225 ml | Water to make 225 ml |

Preparation of a dispersion of zinc hydroxide is mentioned below.

Zinc hydroxide (12.5 g) having a mean grain size of 0.2 μm, 1 g of carboxymethyl cellulose as a dispersing agent, and 0.1 g of sodium polyacrylate were added to 100 ml of an aqueous 4% gelatin solution and ground in a mill with glass beads having a mean grain size of 0.75 mm for 30 minutes. The glass beads were separated to obtain a dispersion of zinc hydroxide.

Preparation of gelatin dispersions of dye-donating compounds is mentioned below.

Cyan dye-donating compound (A1) (7.3 g) shown below, 11.0 g of cyan dye-donating compound (A2) shown below, 0.25 g of compound (D) shown below, 0.8 g of surfactant (1) shown below, 1 g of compound (G) shown below, 7 g of high boiling point organic solvent (1) shown below and 3 g of high boiling point organic solvent (2) shown below were weighed. Ethyl acetate (52 ml) was added thereto to dissolve these under heat at about 60° C. to form a uniform solution. The resulting solution was blended with 65 g of a 16%-solution of lime-processed gelatin and 105 ml of water with stirring and then dispersed with a homogenizer for 10 minutes at 10,000 rpm. Water (180 ml) was added to the resulting dispersion to dilute it. This dispersion is referred to as dispersion of cyan dye-donating compound.

Cyan Dye-Donating Compound (A1):

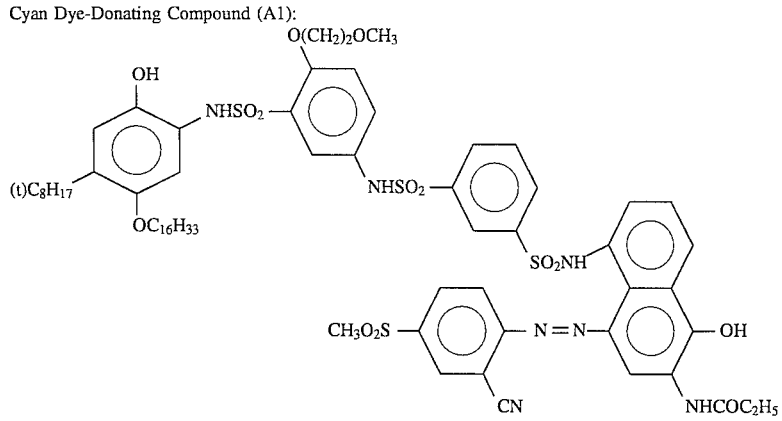

-continued

Cyan Dye-Donating Compound (A2):

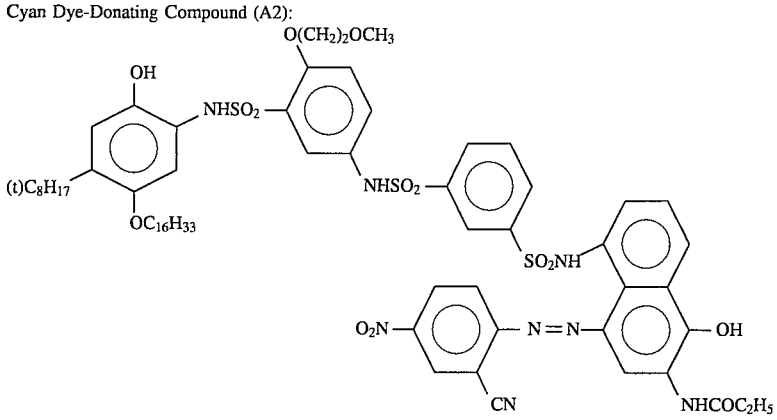

Compound (D):

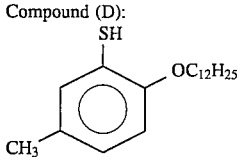

Compound (G):

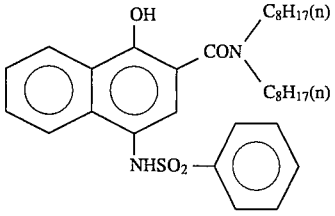

High Boiling Point Organic Solvent (1):

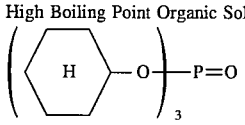

High Boiling Point Organic Solvent (2):

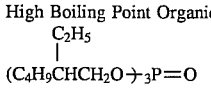

Surfactant (1):

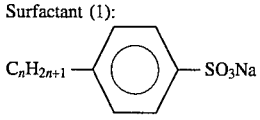

n = 12.6

Magenta dye-donating compound (B) (14.93 g) shown below, 0.17 g of compound (D), 0.17 g of compound (G), 0.315 g of surfactant (1) and 7.4 g of high boiling point organic solvent (2) were weighed. Ethyl acetate (40 ml) was added thereto to dissolve these under heat at about 60° C. to form a uniform solution. The resulting solution was blended with 50 g of a 16%-solution of lime-processed gelatin and 72 ml of water with stirring and then dispersed with a homogenizer for 10 minutes at 10,000 rpm. Water (136 ml) was added to the resulting dispersion to dilute it. This dispersion is referred to as dispersion of magenta dye-donating compound. Magenta Dye-Donating Compound (B):

Magenta Dye-Donating Compound (B):

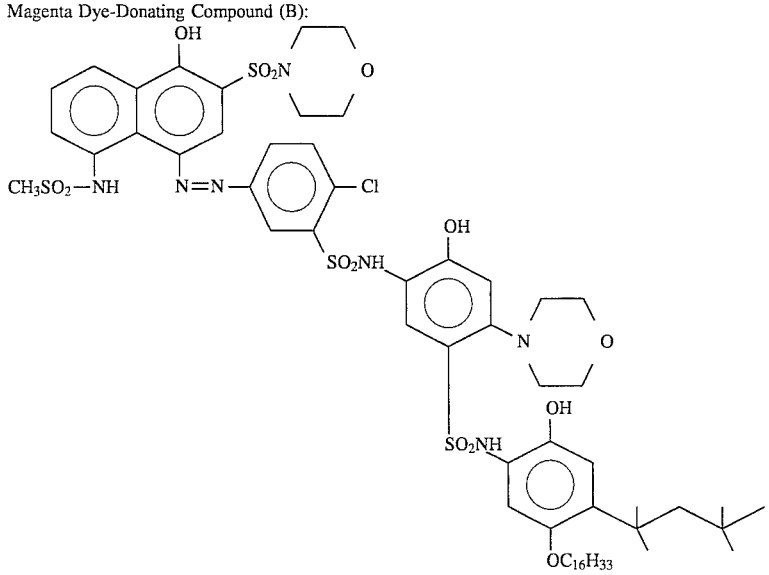

Yellow dye-donating compound (C) (15 g) shown below, 4.7 g of compound (E), 1.88 g of compound (G), 1.74 g of surfactant (1), 15 g of high boiling point organic solvent (1) and 11.4 g of compound (F) shown below were weighed. Ethyl acetate (50 ml) was added thereto to dissolve these under heat at about 60° C. to form a uniform solution. The resulting solution was blended with 67 g of a 16%-solution of lime-processed gelatin and 107 ml of water with stirring and then dispersed with a homogenizer for 10 minutes at 10,000 rpm. Water (90 ml) was added to the resulting dispersion to dilute it. This dispersion is referred to as dispersion (1) of yellow dye-donating compound.

resulting solution was blended with 67 g of a 16%-solution of lime-processed gelatin and 107 ml of water with stirring and then dispersed with a homogenizer for 10 minutes at 10,000 rpm. Water (90 ml) was added to the resulting dispersion to dilute it. This dispersion is referred to as dispersion (2) of yellow dye-donating compound.

Dispersions (3) to (20) of yellow dye-donating compound were prepared in the same manner as in preparation of dispersion (2) of yellow dye-donating compound, except that the compound shown in Table 6 below was used in place of compound (S-1).

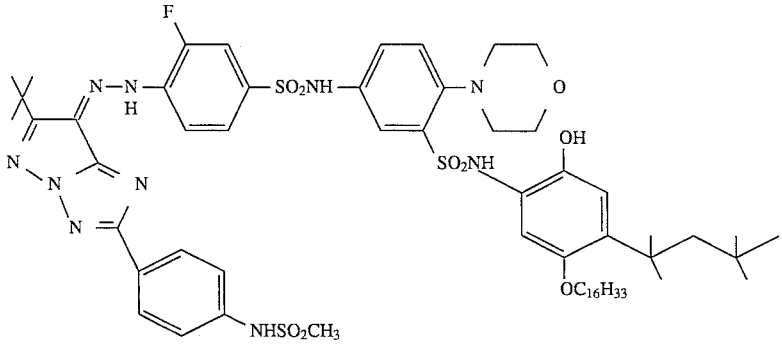

Compound (E):

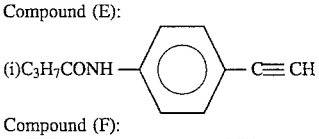

Compound (F):

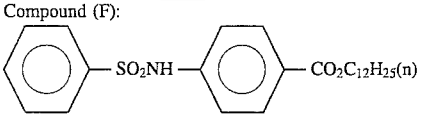

Yellow dye-donating compound (C) (15 g) , 4.7 g of compound (E), 1.88 g of compound (G), 1.74 g of surfactant (1), 18.8 g of high boiling point organic solvent (1) and 3.9 g of compound (S-1) of the present invention were weighed. Ethyl acetate (50 ml) was added thereto to dissolve these under heat at about 60° C. to form a uniform solution. The

TABLE 6

| Compound | Dispersion of Yellow Dye-Donating Compound |
|---|---|
| S-1 | (2) |
| S-4 | (3) |
| S-8 | (4) |
| S-9 | (5) |
| S-10 | (6) |
| S-14 | (7) |
| S-19 | (8) |
| S-25 | (9) |
| S-27 | (10) |
| S-31 | (11) |
| S-34 | (12) |
| S-35 | (13) |
| S-40 | (14) |
| S-41 | (15) |
| S-43 | (16) |
| A-1 | (17) |
| A-2 | (18) |
| A-3 | (19) |
| A-4 | (20) |

A-1

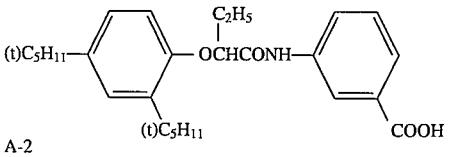

A-2

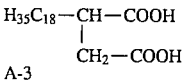

A-3

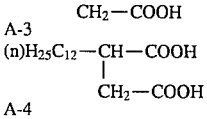

A-4

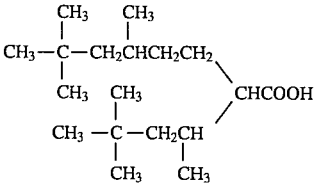

Using these, a sample of heat-developable light-using sensitive material (Sample No. 101) having the constitution mentioned below was prepared:

Constitution of Light-sensitive Material Sample No. 101:

Seventh Layer: Protective Layer

| | |
|---|---|
| Acid-processed gelatin | 0.424 g/m$^2$ |
| PMMA matting agent | 0.11 g/m$^2$ |
| Surfactant (4) | 0.016 g/m$^2$ |
| Surfactant (3) | 0.0017 g/m$^2$ |
| $Ca(NO_3)_2$ | 0.005 g/m$^2$ |

Sixth Layer: Interlayer

| | |
|---|---|
| Gelatin | 0.55 g/m$^2$ |
| $Zn(OH)_2$ | 0.30 g/m$^2$ |
| Surfactant (4) | 0.0046 g/m$^2$ |
| Surfactant (2) | 0.0057 g/m$^2$ |
| $Ca(NO_3)_2$ | 0.005 g/m$^2$ |
| Water-soluble polymer (1) | 0.008 g/m$^2$ |

Fifth Layer: Blue-sensitive Layer

| | |
|---|---|
| Silver halide emulsion (4) | 0.30 g/m$^2$ in terms of Ag |
| Gelatin | 0.42 g/m$^2$ |

Dispersion (1) of yellow dye-donating compound

| | |
|---|---|
| Yellow dye-donating compound (C) | 0.331 g/m$^2$ |

-continued

Constitution of Light-sensitive Material Sample No. 101:

| | |
|---|---|
| Compound (E) | 0.103 g/m$^2$ |
| Compound (G) | 0.042 g/m$^2$ |
| Compound (F) | 0.252 g/m$^2$ |
| High boiling point organic solvent (1) | 0.331 g/m$^2$ |
| Surfactant (1) | 0.038 g/m$^2$ |
| Water-soluble polymer (1) | 0.004 g/m$^2$ |

Fourth Layer: Interlayer

| | |
|---|---|
| Gelatin | 0.43 g/m$^2$ |
| Hardening Agent | 0.034 g/m$^2$ |
| Surfactant (5) | 0.090 g/m$^2$ |
| Surfactant (4) | 0.007 g/m$^2$ |
| $Ca(NO_3)_2$ | 0.009 g/m$^2$ |
| Water-soluble polymer (1) | 0.019 g/m$^2$ |

Third Layer: Green-sensitive Layer

| | |
|---|---|
| Silver halide emulsion (2) | 0.33 g/m$^2$ in terms of Ag |
| Gelatin | 0.40 g/m$^2$ |
| Magenta dye-donating compound (B) | 0.44 g/m$^2$ |
| Compound (D) | 0.005 g/m$^2$ |
| Compound (G) | 0.005 g/m$^2$ |
| High boiling point organic solvent (2) | 0.219 g/m$^2$ |
| Surfactant (1) | 0.009 g/m$^2$ |
| Water-soluble polymer | 0.005 g/m$^2$ |

Second Layer: Interlayer

| | |
|---|---|
| Gelatin | 0.38 g/m$^2$ |
| $Zn(OH)_2$ | 0.284 g/m$^2$ |
| Surfactant (5) | 0.09 g/m$^2$ |
| Surfactant (4) | 0.007 g/m$^2$ |
| $Ca(NO_3)_2$ | 0.009 g/m$^2$ |
| Water-soluble polymer (1) | 0.015 g/m$^2$ |

First Layer: Red-sensitive Layer

| | |
|---|---|
| Silver halide emulsion (1) | 0.19 g/m$^2$ in terms of Ag |
| Gelatin | 0.27 g/m$^2$ |
| Cyan dye-donating compound (A1) | 0.110 g/m$^2$ |
| Cyan dye-donating compound (A2) | 0.165 g/m$^2$ |
| Compound (D) | 0.004 g/m$^2$ |
| Compound (G) | 0.016 g/m$^2$ |
| High boiling point organic solvent (1) | 0.108 g/m$^2$ |
| High boiling point organic solvent (2) | 0.046 g/m$^2$ |
| Surfactant (1) | 0.012 g/m$^2$ |
| Water-soluble polymer (1) | 0.010 g/m$^2$ |
| Stabilizer | 0.004 g/m$^2$ |

Zeroth Layer: Subbing Layer

| | |
|---|---|
| Gelatin | 0.121 g/m$^2$ |
| Surfactant (4) | 0.003 g/m$^2$ |
| Water-soluble polymer (1) | 0.006 g/m$^2$ |

Support (1):
Polyethylene-laminated paper support (thickness: 131 μm), having the constitution mentioned below.

| | | |
|---|---|---|
| Constitution of Support (1): | | 131.2μm |
| Surface Subbing Layer: | | 0.1μm |
| Gelatin | | |
| Surface PE Layer (glossy): | | 36.0μm |
| Low-density polyethylene (density: 0.923) | 89.2 parts | |
| Surface-treated titanium oxide: | 10.0 parts | |
| Ultramarine | 0.8 parts | |
| Pulp Layer: | | 64.0μm |
| High-quality paper (LBKP/NBKP = 1/1 with density of 1.080) | | |
| Back PE Layer (mat): | | 31.0μm |
| High-density polyethylene (density: 0.960) | | |
| Back Subbing Layer: | | 0.1μm |
| Gelatin | | |
| Styrene/acrylate copolymer | | |
| Colloidal silica | | |

Constitution of Light-sensitive Material Sample No. 101:

Compounds used above are mentioned below.

Surfactant (2):

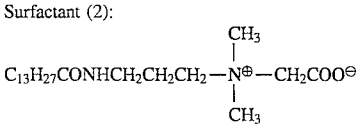

Surfactant (3):

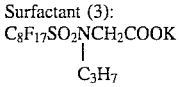

Surfactant (4): Aerosol OT

Surfactant (5)

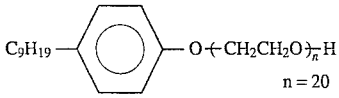

Water-Soluble Polymer (1):

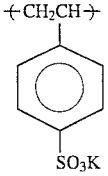

Hardening Agent: $CH_2{=}CHSO_2CH_2SO_2CH{=}CH_2$

Stabilizer:

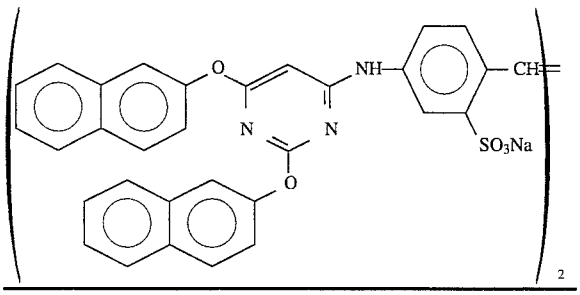

A sample of image-receiving material (Sample No. R201) having the constitution mentioned below was prepared.

Constitution of Image Receiving Material Sample No. R201:

| | |
|---|---|
| Fourth Layer: | |
| Carrageenan | 60 mg/m² |
| Water-soluble polymer (2) | 240 mg/m² |
| Potassium Nitrate | 50 mg/m² |
| Surfactant (7) | 7 mg/m² |
| Surfactant (3) | 5 mg/m² |
| Third Layer: | |
| Gelatin | 250 mg/m² |
| Water-soluble polymer (2) | 10 mg/m² |
| Surfactant (6) | 27 mg/m² |
| Hardening Agent (2) | 170 mg/m² |
| Second Layer: | |
| Gelatin | 800 mg/m² |
| High boiling point solvent (3) | 650 mg/m² |
| Brightening agent (1) | 22 mg/m² |
| Compound (C) | 32 mg/m² |
| Surfactant (4) | 10 mg/m² |
| Mordanting agent (1) | 2350 mg/m² |
| Polymer dispersion | 1190 mg/m² |
| Dextran | 660 mg/m² |
| Water-soluble polymer (2) | 100 mg/m² |

Constitution of Image Receiving Material Sample No. R201:

| | | |
|---|---|---|
| Guanidine Picolinate | | 2900 mg/m² |
| First Layer: | | |
| Gelatin | | 150 mg/m² |
| Water-soluble polymer (2) | | 40 mg/m² |
| Surfactant (4) | | 6 mg/m² |
| Surfactant (6) | | 27 mg/m² |
| Hardening agent (2) | | 170 mg/m² |
| Support (2): | | |
| Polyethylene-laminated paper support (thickness: 206 μm) having the constitution mentioned below. | | |
| Constitution of Support (2): | | 206.0μm |
| Surface Subbing Layer: | | 0.1μm |
| Gelatin | | |
| Surface PE Layer (glossy): | | 35.0μm |
| Low-density polyethylene (density: 0.923) | 89.2 parts | |
| Surface-treated titanium oxide: | 10.0 parts | |
| Ultramarine | 0.8 parts | |
| Pulp Layer: | | 140.8μm |
| High-quality paper (LBKP/NBKP = 1/1 with density of 1.080) | | |
| Back PE Layer (mat): | | 30.0μm |
| High-density polyethylene (density: 0.960) | | |
| Back Subbing Layer: | | 0.1μm |
| Gelatin | | |
| Styrene/acrylate copolymer | | |
| Colloidal silica | | |

Compounds used above are mentioned below.

Water-soluble Polymer (2):
Sumikagel 5-H (product of Sumitomo Chemical Company, Limited)
Polymer Dispersion:
Nipol LX814 (product of Nippon Zeon Co., Ltd.)
Surfactant (6):

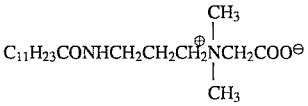

Surfactant (7):

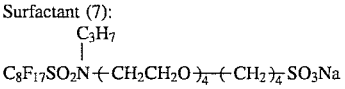

High Boiling Point Solvent (3):
$C_{26}H_{46.9}Cl_{7.1}$

Brightening Agent (1):

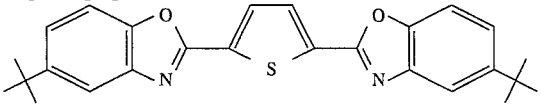

Compound (C):

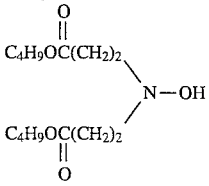

Mordanting Agent (1):

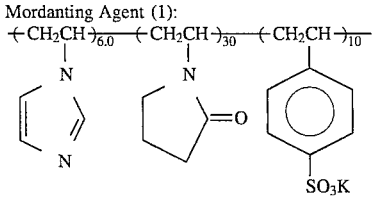

-continued

Constitution of Image Receiving Material Sample No. R201:

Hardening Agent (2):

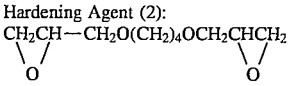

Samples of light-sensitive material (Samples Nos. 102 and 105) were prepared in the manner mentioned below.

Light-sensitive material sample No. 102 was prepared in the same manner as in preparation of light-sensitive material sample No. 101, except that silver halide emulsion (3) was used in place of silver halide emulsion (4).

Light-sensitive material sample No. 105 was prepared in the same manner as in preparation of light-sensitive material sample No. 101, except that silver halide emulsion (3) was used in place of silver halide emulsion (4) in the blue-sensitive layer and that dispersion (2) of yellow dye-donating compound was used in place of dispersion (1) of yellow dye-donating compound.

In the same manner as above, light-sensitive material samples Nos. 103 to 124 shown in Table 7 below were prepared.

TABLE 7

| Light-Sensitive Material Sample No. | Silver Halide Emulsion in Blue-Sensitive Layer | Dispersion of yellow Dye-Donating Compound |
|---|---|---|
| 101 (Comparison) | (4) | (1) |
| 102 (Comparison) | (3) | (1) |
| 103 (Comparison) | (5) | (1) |
| 104 (Invention) | (4) | (2) |
| 105 (Invention) | (3) | (2) |
| 106 (Invention) | (5) | (2) |
| 107 (Invention) | (4) | (3) |
| 108 (Invention) | (4) | (4) |
| 109 (Invention) | (4) | (5) |
| 110 (Invention) | (4) | (6) |
| 111 (Invention) | (4) | (7) |
| 112 (Invention) | (4) | (8) |
| 113 (Invention) | (4) | (9) |
| 114 (Invention) | (4) | (10) |
| 115 (Invention) | (4) | (11) |
| 116 (Invention) | (4) | (12) |
| 117 (Invention) | (4) | (13) |
| 118 (Invention) | (4) | (14) |
| 119 (Invention) | (4) | (15) |
| 120 (Invention) | (4) | (16) |
| 121 (Comparison) | (4) | (17) |
| 122 (Comparison) | (4) | (18) |
| 123 (Comparison) | (4) | (19) |
| 124 (Comparison) | (4) | (20) |

Light-sensitive material samples Nos. 101 to 124 were exposed and processed in the manner mentioned below.

Precisely, using a tungsten bulb, each sample was exposed at 2,500 luxes for 1/10 second through a B-G-R three-color separation filter (composed of a 600 to 700 nm band-pass filter for R, a 500 to 590 nm band-pass filter for G and a 400 to 490 nm band-pass filter for B).

Water was applied to the emulsion-coated surface of each of these exposed samples, using a wire bar, and each sample was then attached to image-receiving material sample No. 201 in such a way that the coated surfaces thereof faced each other. The combined samples were then heated at varying temperatures of 78° C., 83° C. and 88° C. for 30 seconds, and thereafter the light-sensitive material sample was peeled off from the dye-fixing material sample. Thus, an image was formed on the dye-fixing material sample.

The reflection density of the image thus obtained was measured, using a reflection densitometer X-Rite 310 through a filter Status A. Table 8 below shows the fog and the relative sensitivity of each sample at the developing temperatures of 78° C., 83° C. and 88° C. The sensitivity indicates a reciprocal of the exposure amount of giving a density of 1.5 and was represented as the relative value (logarithmic number) based on the sensitivity (1.00) of light-sensitive material sample No. developed at 83° C.

TABLE 8

| Light-sensitive | Fog/Yellow | | | Fluctuation in Sensitivity/Yellow | | |
|---|---|---|---|---|---|---|
| Material Sample No. | Developed at 78° C. | Developed at 83° C. | Developed at 88° C. | Developed at 78° C. | Developed at 83° C. | Developed at 88° C. |
| 101 (Comparison) | 0.09 | 0.14 | 0.20 | 0.95 | 1.00 | 1.05 |
| 102 (Comparison) | 0.09 | 0.14 | 0.19 | 0.84 | 0.90 | 0.95 |
| 103 (Comparison) | 0.10 | 0.15 | 0.22 | 0.79 | 0.85 | 0.90 |
| 104 (Invention) | 0.05 | 0.07 | 0.10 | 0.97 | 1.00 | 1.03 |
| 105 (Invention) | 0.05 | 0.06 | 0.10 | 0.88 | 0.91 | 0.94 |
| 106 (Invention) | 0.06 | 0.09 | 0.12 | 0.82 | 0.85 | 0.91 |
| 107 (Invention) | 0.05 | 0.08 | 0.11 | 0.97 | 1.00 | 1.04 |
| 108 (Invention) | 0.05 | 0.08 | 0.10 | 0.97 | 1.00 | 1.03 |
| 109 (Invention) | 0.06 | 0.09 | 0.12 | 0.95 | 1.00 | 1.04 |
| 110 (Invention) | 0.06 | 0.09 | 0.12 | 0.94 | 1.01 | 1.04 |

TABLE 8-continued

| Light-sensitive Material Sample No. | Fog/Yellow Developed at 78° C. | Developed at 83° C. | Developed at 88° C. | Fluctuation in Sensitivity/Yellow Developed at 78° C. | Developed at 83° C. | Developed at 88° C. |
|---|---|---|---|---|---|---|
| 111 (Invention) | 0.06 | 0.09 | 0.13 | 0.89 | 1.00 | 1.04 |
| 112 (Invention) | 0.06 | 0.09 | 0.12 | 0.95 | 1.00 | 1.03 |
| 113 (Invention) | 0.07 | 0.09 | 0.12 | 0.92 | 0.99 | 1.05 |
| 114 (Invention) | 0.07 | 0.09 | 0.13 | 0.89 | 1.00 | 1.04 |
| 115 (Invention) | 0.06 | 0.09 | 0.11 | 0.95 | 1.00 | 1.04 |
| 116 (Invention) | 0.06 | 0.08 | 0.12 | 0.94 | 1.00 | 1.03 |
| 117 (Invention) | 0.06 | 0.09 | 0.12 | 0.95 | 1.01 | 1.04 |
| 118 (Invention) | 0.06 | 0.09 | 0.11 | 0.95 | 1.00 | 1.03 |
| 119 (Invention) | 0.07 | 0.09 | 0.12 | 0.93 | 1.02 | 1.05 |
| 120 (Invention) | 0.07 | 0.09 | 0.12 | 0.92 | 1.00 | 1.05 |
| 121 (Comparison) | 0.06 | 0.09 | 0.12 | 0.87 | 1.00 | 1.06 |
| 122 (Comparison) | 0.08 | 0.11 | 0.14 | 0.85 | 1.01 | 1.04 |
| 123 (Comparison) | 0.09 | 0.12 | 0.15 | 0.86 | 1.02 | 1.06 |
| 124 (Comparison) | 0.09 | 0.12 | 0.14 | 0.84 | 1.00 | 1.05 |

From these results, it is obvious that the light-sensitive material samples according to the present invention have a low fog while having a little fluctuation in the sensitivity at varying developing temperatures.

The light-sensitive material sample according to the present invention and the image-receiving material sample were formed into a roll film and loaded in Fujix Pictrostat 200 (sold by Fuji Photo Film Co. since December 1992 in Japan). On the other hand, a processed negative of Fujicolor Super G400 was loaded in a slide enlarger unit. These were processed under the standard condition of Fujix Pictrostat 200 for the water application, the film conveyance and the exposure control, except that the developing temperature was 83° C. and the developing time was 30 seconds.

All the light-sensitive material samples had a print image printed from the negative. In particular, light-sensitive material samples Nos. 104, 105, 107 and 108 according to the present invention had a good white background and a high maximum sensitivity, and the quality of the images formed on these samples were extremely excellent.

Using negatives of Fujicolor Super G100 and Eastman Kodak's Super Gold 100, 200 and 400, in place of Fujicolor Super G400, excellent images were also formed on the light-sensitive material samples according to the present invention.

EXAMPLE 2

Preparation of light-sensitive silver halide emulsions is mentioned below. Light-Sensitive Silver Halide Emulsion (1) (for 5th layer (680 nm light-sensitive layer)):

Solution (I) and Solution (II) shown in Table 10 below were simultaneously added to a well stirred aqueous solution having the composition shown in Table 9 below, over a period of 13 minutes. After 10 minutes, Solution (III) and Solution (IV) also shown in Table 10 were added thereto over a period of 33 minutes.

TABLE 9

| Component | Amount |
|---|---|
| $H_2O$ | 620 ml |
| Lime-processed Gelatin | 20 g |
| KBr | 0.3 g |
| NaCl | 2 g |
| Compound (a) | 0.030 g |
| Sulfuric Acid (1N) | 16 ml |
| Temperature | 45° C. |

TABLE 10

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| Total | Water to make 126 ml | Water to make 132 ml | Water to make 254 ml | Water to make 252 ml |

Thirty minutes after the start of the addition of Solution (III), 150 ml of an aqueous solution containing 0.350% of sensitizing dye (a) shown below were added to the above, over a period of 27 minutes.

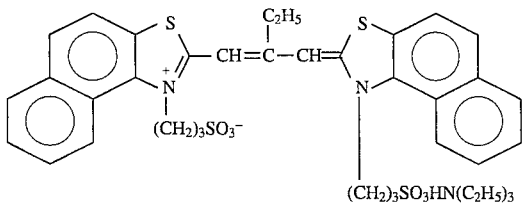

This was rinsed with water and desalted (at pH of 4.1 by adding flocculator (b) shown below thereto) by an ordinary method, and 22 g of lime-processed ossein gelatin were added thereto, and pH and pAg thereof were adjusted to be 6.0 and to 7.9, respectively. Then, this was subjected to chemical sensitization at 60° C. The compounds used for the chemical sensitization are shown in Table 11 below. The yield of the emulsion was 630 g. The emulsion was a monodispersed emulsion of cubic silver chlorobromide grains having a mean grain size of 0.20 μm and having a fluctuation coefficient of 10.2%.

Flocculator (b):

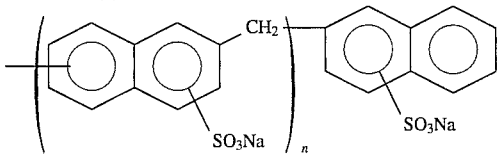

TABLE 11

| Chemicals for Chemical Sensitization | Amount Added |
|---|---|
| 4-Hydroxy-6-methyl-1,3,3a,7-tetrazaindene | 0.36 g |
| Sodium Thiosulfate | 6.75 mg |
| Anti-foggant (3) | 0.11 g |
| Antiseptic (1) | 0.07 g |
| Antiseptic (2) | 3.13 g |

Antiseptic (1):

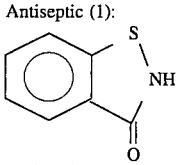

Antiseptic (2):

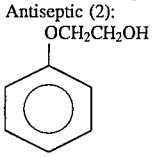

Light-Sensitive Silver Halide Emulsion (2) (for 3rd layer (750 nm light-sensitive layer)):

Solution (I) and Solution (II) shown in Table 13 below were simultaneously added to a well stirred aqueous solution having the composition shown in Table 12 below, over a period of 18 minutes. After 10 minutes, Solution (III) and Solution (IV) also shown in Table 13 were added thereto over a period of 24 minutes.

TABLE 12

| Component | Amount |
|---|---|
| $H_2O$ | 620 ml |
| Lime-processed Gelatin | 20 g |
| KBr | 0.3 g |
| NaCl | 2 g |
| Compound (a) | 0.030 g |
| Sulfuric Acid (1N) | 16 ml |
| Temperature | 45° C. |

TABLE 13

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_4[Fe(CN)_6].H_2O$ | — | — | — | 0.07 g |
| $K_2IrCl_6$ | — | — | — | 0.040 mg |
| Total | Water to make 188 ml | Water to make 188 ml | Water to make 250 ml | Water to make 250 ml |

This was rinsed with water and desalted (at pH of 3.9 by adding flocculator (a) thereto) by an ordinary method, and 22 g of calcium-removed, lime-processed ossein gelatin (calcium content: 150 ppm or less) were added thereto and again dispersed. 4-Hydroxy-6-methyl-1,3,3a,7-tetrazaindene (0.39 g) was added to this, and pH and pAg thereof were adjusted to be 5.9 and 7.8, respectively. Then, this was subjected to chemical sensitization at 70° C., using the chemicals shown in Table 14 below. At the last of the chemical sensitization, a methanol solution of sensitizing dyes (2) and (3) shown below (having the composition shown in Table 15 below) was added to this. After the chemical sensitization, this was cooled to 40° C., 200 g of a gelatin dispersion of stabilizer (1) were added thereto and well stirred. This was then stored. The yield of the emulsion was 938 g. The emulsion was a monodispersed emulsion of cubic silver chlorobromide grains having a mean grain size of 0.25 μm and having a fluctuation coefficient of 12.6%.

TABLE 14

| Chemicals for Chemical Sensitization | Amount Added |
|---|---|
| 4-Hydroxy-6-methyl-1,3,3a,7-tetrazaindene | 0.39 g |
| Triethylthiourea | 3.3 mg |
| Decomposate of Nucleic Acid | 0.39 g |
| NaCl | 0.15 g |
| KI | 0.12 g |
| Anti-foggant (4) | 0.10 g |
| Antiseptic (1) | 0.07 g |

TABLE 15

| Composition of Dye Solution | Amount Added |
|---|---|
| Sensitizing Dye (2) | 0.12 g |
| Sensitizing Dye (3) | 0.06 g |
| Paratoluenesulfonic Acid | 0.71 g |
| Methanol | 18.7 ml |

Anti-foggant (4):

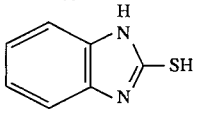

Sensitizing Dye (2):

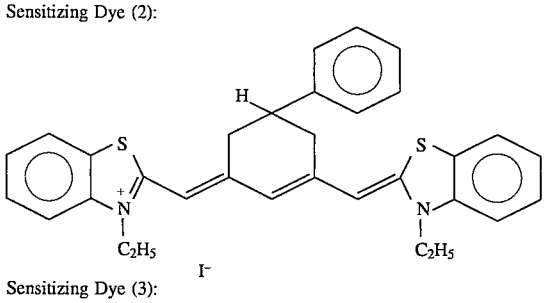

Sensitizing Dye (3):

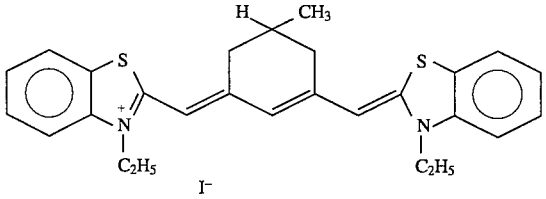

Light-Sensitive Silver Halide Emulsion (3) (for 1st layer (810 nm light-sensitive layer)):

Solution (I) and Solution (II) shown in Table 17 below were simultaneously added to a well stirred aqueous solution having the composition shown in Table 16 below, over a period of 18 minutes. After 10 minutes, Solution (III) and Solution (IV) also shown in Table 17 were added thereto over a period of 24 minutes.

TABLE 16

| Component | Amount |
|---|---|
| $H_2O$ | 620 ml |
| Lime-processed Gelatin | 20 g |
| KBr | 0.3 g |
| NaCl | 2 g |
| Compound (a) | 0.030 g |
| Sulfuric Acid (1N) | 16 ml |
| Temperature | 50° C. |

TABLE 17

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.1 g |
| NaCl | — | 3.62 g | — | 2.4 g |
| $K_2IrCl_6$ | — | — | — | 0.020 mg |
| Total | Water to make 180 ml | Water to make 181 ml | Water to make 242 ml | Water to make 250 ml |

This was rinsed with water and desalted (at pH of 3.8 by adding flocculator (b) thereto) by an ordinary method, and 22 g of lime-processed ossein gelatin were added thereto, and pH and pAg thereof were adjusted to be 7.4 and 7.8, respectively. Then, this was subjected to chemical sensitization at 60° C. The compounds used for the chemical sensitization are shown in Table 18 below. The yield of the emulsion was 680 g. The emulsion was a monodispersed emulsion of cubic silver chlorobromide grains having a mean grain size of 0.32 μm and having a fluctuation coefficient of 9.7%.

TABLE 18

| Chemicals for Chemical Sensitization | Amount Added |
|---|---|
| 4-Hydroxy-6-methyl-1,3,3a,7-tetrazaindene | 0.38 g |
| Triethylthiourea | 3.10 mg |
| Anti-foggant (4) | 0.19 g |
| Antiseptic (1) | 0.07 g |
| Antiseptic (2) | 3.13 g |

Preparation of gelatin dispersions of hydrophobic additives is mentioned below.

Gelatin dispersions of yellow dye-donating compound, magenta dye-donating compound and cyan dye-donating compound were prepared, each having the formulation shown in Table 19 below. Briefly, the components of the oily phase were dissolved under heat at about 70° C. to form a uniform solution, and the solution was blended and stirred with the components of the aqueous phase heated at about 60° C. The resulting mix was then dispersed in a homogenizer for 10 minutes at 10,000 rpm. Water was added thereto to obtain a uniform dispersion. The gelatin dispersion of cyan dye-donating compound was repeatedly diluted and concentrated, using an ultra-filtration module (ACV-3050, produced by Asahi Chemical Industry, Co., Ltd.), by which the amount of ethyl acetate in this was reduced to 1/17.6 of the amount thereof indicated in Table 19.

TABLE 19

| | Composition of Dispersion | | |
|---|---|---|---|
| | Yellow | Magenta | Cyan |
| Oily Phase | | | |
| Cyan Dye-Donating Compound (A1) | — | — | 7.3 g |
| Cyan Dye-Donating Compound (A2) | — | — | 10.7 g |
| Magenta Dye-Donating Compound (B) | — | 18.1 g | — |
| Yellow Dye-Donating Compound (C) | 10.1 g | — | — |
| Compound (G) | 1.8 g | 0.81 g | 1.0 g |
| Compound (D) | 0.1 g | — | 0.2 g |
| Compound (E) | — | 0.7 g | — |
| Surfactant (1) | 1.1 g | — | — |
| High Boiling Point Solvent (1) | 5.0 g | — | 4.6 g |
| High Boiling Point Solvent (2) | — | 13.5 g | 4.9 g |
| High Boiling Point Solvent (3) | — | — | 1.2 g |
| Dye (d) | 1.1 g | — | 0.5 g |
| Water | 0.4 ml | — | — |
| Ethyl Acetate | 9.6 ml | 50.1 ml | 55.2 ml |
| Aqueous Phase | | | |
| Lime-Processed Gelatin | 10.0 g | 10.0 g | 10.0 g |
| Calcium Nitrate | 0.1 g | 0.1 g | — |
| Surfactant (1) | — | 0.2 g | 0.8 g |
| Aqueous Solution of Sodium Hydroxide (1 N) | — | 1.9 ml | — |
| Carboxymethyl Cellulose | — | — | 0.3 g |
| Water | 26.1 ml | 139.7 ml | 95.9 ml |
| Water Added | 99.9 ml | 157.3 ml | 209.0 ml |
| Antiseptic (1) | 0.004 g | 0.04 g | 0.1 g |

Dye (d):

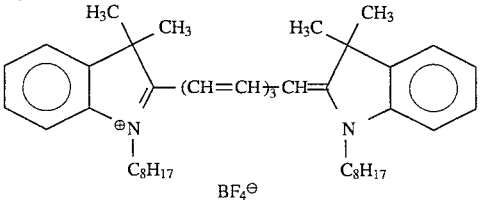

High Boiling Point Organic Solvent (3):

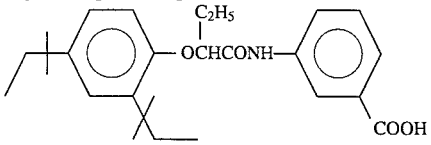

A gelatin dispersion of the same stabilizer as that used in Example 1 was formulated to have the composition shown in Table 20 below. Precisely, the oily components were dissolved at room temperature. The aqueous components that had been heated at about 40° C. were added to the resulting oily solution, stirred, mixed and then dispersed in a homogenizer for 10 minutes at 10,000 rpm. Water was added thereto and stirred to form a uniform dispersion.

TABLE 20

| | Components | Amount |
|---|---|---|
| Oily Phase | Stabilizer | 4.0 g |
| | Sodium Hydroxide | 0.3 g |
| | Methanol | 62.8 g |
| | High Boiling Point Solvent (4) | 0.9 g |
| Aqueous Phase | Calcium-removed Gelatin (Ca content: 100 ppm or less) | 10.0 g |
| | Antiseptic (1) | 0.04g |

A gelatin dispersion of zinc hydroxide was formulated to have the composition shown in Table 21 below. Precisely, the components were mixed and then dispersed in a mill for 30 minutes, using glass beads having a mean particle size of 0.75 mm. After the glass beads were removed, a uniform dispersion was obtained. The zinc hydroxide used was in the form of grains having a mean grain size of 0.25 μm.

TABLE 21

| Components | Amount |
|---|---|
| Zinc Hydroxide | 15.9 g |
| Carboxymethyl Cellulose | 0.7 g |
| Sodium Polyacrylate | 0.07 g |
| Lime-Processed Gelatin | 4.2 g |
| Water | 100 ml |
| High Boiling Point Solvent (4) | 0.4 g |

A gelatin dispersion of a matting agent to be added to the protective layer of the light-sensitive material samples prepared herein was prepared in the manner mentioned below. Precisely, a solution that had been prepared by dissolving PMMA in methylene chloride was added to gelatin along with small amounts of surfactants and dispersed by rapid stirring. The methylene chloride was removed from this, using a reduced-pressure solvent-removing device. Thus, a uniform dispersion having a mean grain size of 4.3 μm was obtained. High Boiling Point Organic Solvent (4) (this is the same as Antiseptic (2)):

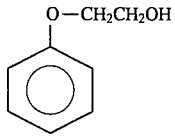

Using these, prepared was heat-developable light-sensitive material sample (Sample No. 200 mentioned below) for a full-color digital printer where light-sensitive materials are exposed to three-color semiconductor lasers (675 nm, 755 nm, 815 nm).

| Seventh Layer: Protective Layer | |
|---|---|
| Acid-processed gelatin | 442 mg/m$^2$ |
| Mat agent (PMMA resin) | 17 mg/m$^2$ |
| Surfactant (4) | 16 mg/m$^2$ |
| Surfactant (1) | 9 mg/m$^2$ |
| Surfactant (3) | 2 mg/m$^2$ |
| **Sixth Layer: Interlayer** | |
| Lime-processed gelatin | 862 mg/m$^2$ |
| Zinc hydroxide | 480 mg/m$^2$ |
| Water-soluble polymer (1) | 4 mg/m$^2$ |
| Surfactant (3) | 0.4 mg/m$^2$ |
| Calcium Nitrate | 14 mg/m$^2$ |

-continued

| Fifth Layer: Red-sensitive Layer | |
|---|---|
| Lime-processed gelatin | 452 mg/m$^2$ |
| Light-sensitive silver halide | 301 mg/m$^2$ |
| emulsion (1) | in terms of Ag |
| Magenta dye-donating compound (B) | 543 mg/m$^2$ |
| High boiling point solvent (2) | 407 mg/m$^2$ |
| Compound (G) | 24 mg/m$^2$ |
| Compound (E) | 20 mg/m$^2$ |
| Surfactant (1) | 0.3 mg/m$^2$ |
| Water-soluble polymer (1) | 11 mg/m$^2$ |
| **Fourth Layer: Interlayer** | |
| Lime-processed gelatin | 485 mg/m$^2$ |
| Zinc hydroxide | 270 mg/m$^2$ |
| Water-soluble polymer (1) | 2 mg/m$^2$ |
| Surfactant (3) | 0.3 mg/m$^2$ |
| Calcium nitrate | 8 mg/m$^2$ |
| **Third Layer: Second Infrared-sensitive Layer** | |
| Lime-processed gelatin | 373 mg/m$^2$ |
| Light-sensitive silver halide | 106 mg/m$^2$ |
| emulsion (2) | in terms of Ag |
| Stabilizer | 9 mg/m$^2$ |
| Cyan dye-donating compound (A2) | 233 mg/m$^2$ |
| Cyan dye-donating compound (A1) | 159 mg/m$^2$ |
| Dye (d) | 10 mg/m$^2$ |
| High boiling point solvent (1) | 101 mg/m$^2$ |
| High boiling point solvent (2) | 108 mg/m$^2$ |
| High boiling point solvent (3) | 27 mg/m$^2$ |
| Compound (G) | 22 mg/m$^2$ |
| Compound (D) | 4 mg/m$^2$ |
| Surfactant (1) | 0.9 mg/m$^2$ |
| Carboxymethyl cellulose | 5 mg/m$^2$ |
| Water-soluble polymer (1) | 11 mg/m$^2$ |
| **Second Layer: Interlayer** | |
| Lime-processed gelatin | 438 mg/m$^2$ |
| Surfactant (3) | 4 mg/m$^2$ |
| Surfactant (5) | 123 mg/m$^2$ |
| Water-soluble polymer (1) | 26 mg/m$^2$ |
| Anti-foggant (5) | 6 mg/m$^2$ |
| Calcium nitrate | 8 mg/m$^2$ |
| **First Layer: First Infrared-sensitive Layer** | |
| Lime-processed gelatin | 587 mg/m$^2$ |
| Light-sensitive silver halide | 311 mg/m$^2$ |
| emulsion (3) | in terms of Ag |
| Stabilizer | 8 mg/m$^2$ |
| Yellow dye-donating compound (C) | 403 mg/m$^2$ |
| Sensitizing dye (4) | 0.1 mg/m$^2$ |
| Dye (d) | 44 mg/m$^2$ |
| High boiling point solvent (1) | 201 mg/m$^2$ |
| Compound (G) | 70 mg/m$^2$ |
| Compound (D) | 4 mg/m$^2$ |
| Surfactant (1) | 32 mg/m$^2$ |
| Water-soluble polymer (1) | 46 mg/m$^2$ |
| Hardening agent | 45 mg/m$^2$ |

Support:
Polyethylene-laminated paper support (thickness: 96 μm)
(Note:
Minor additives such as antiseptic, etc. were omitted.)

Compounds used above are mentioned below.

Anti-foggant (5):

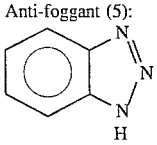

Sensitizing Dye (4):

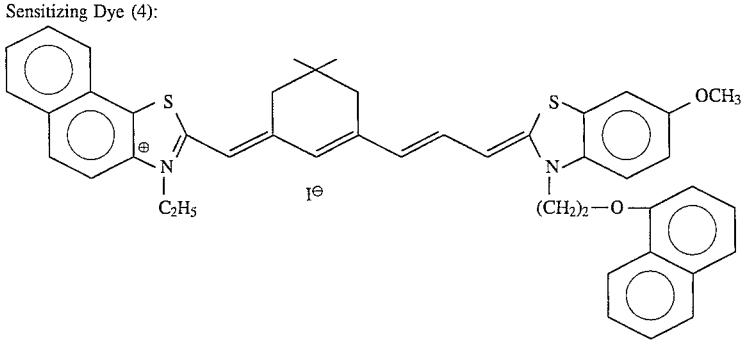

Next, light-sensitive material sample No. 201 was prepared in the same manner as in preparation of light-sensitive material sample No. 200, except that 3.08 g of compound (S-1) were added to the dispersion of yellow dye-donating compound in Table 19 above. Accordingly, Sample No. 201 contained 126 mg/m$^2$ of compound (S-1) in the first layer.

Each of light-sensitive materials samples Nos. 200 and 201 was combined with a dye-fixing material, PG-SG (for PG-3000) and was processed, using a digital color printer, Fujix Pictrography PG-3000 produced by Fuji Photo Film Co., Ltd., under the standard condition for the processor.

Prior to the development, the light-sensitive material samples were sensitometrically exposed, using an exposing device having the optical system illustrated in FIG. 2 in JP-A-6-127021, under the condition indicated in Table 22 below. The maximum densities of the thus-exposed samples were measured, using a reflection densitometer, X-Rite 310 produced by X-Rite Co., Ltd.

TABLE 22

| | |
|---|---|
| Beam Intensity on Sample: | Laser beam intensity at 675 nm: 60 μW<br>Laser beam intensity at 755 nm: 250 μW<br>Laser beam intensity at 815 nm: 250 μW |
| Scanning Line Density: | 1600 dpi (63 lusters/mm) |
| Beam Diameter: | 85 ± 8.5 μm in the main scanning direction<br>55 ± 5.5 μm in the sub-scanning direction |
| Exposure Time: | 667 μsec/luster<br>repeating period: 1.33 msec |
| Laser Ray Wavelength for Exposure: | 675 nm, 755 nm, 815 nm (laser rays) |
| Exposure Amount: | 1 log E variation (for each track) per 2.5 cm in the sub-scanning direction |
| Method of Varying Exposure Amount: | Emission Time modulation (according to the method described in JP-A-5-199372) |

The results obtained are shown in Table 23 below.

TABLE 23

| Light-sensitive Material | Maximum Density | | | |
|---|---|---|---|---|
| Sample No. | Yellow | Magenta | Cyan | Remarks |
| 200 | 1.62 | 2.21 | 2.30 | Comparison |
| 201 | 2.04 | 2.22 | 2.30 | Invention |

From the results in Table 23 above, it is known that the maximum densities of Sample No. 201 are higher than those of Sample No. 200. Thus, Sample No. 201 is superior to Sample No. 200.

While the invention has been described in detail and with reference to specific embodiments thereof, it will be apparent to one skilled in the art that various changes and modifications can be made therein without departing from the spirit and scope thereof.

What is claimed is:

1. A heat-developable color light-sensitive material comprising a light-sensitive silver halide, a binder, a dye-donating compound and at least one compound represented by the following formula (I) on a support:

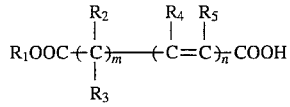

(I)

wherein $R_1$ represents an alkyl group having from 1 to 30 carbon atoms, an alkenyl group having from 2 to 30 carbon atoms, or a cycloalkyl group having from 3 to 30 carbon atoms;

$R_2$, $R_3$, $R_4$ and $R_5$ each independently represents a hydrogen atom, an alkyl group having from 1 to 30 carbon atoms, or an alkenyl group having from 2 to 30 carbon atoms;

m represents an integer of from 0 to 10; and n represents 0 or 1;

with the proviso that, when m is an integer of from 1 to 10, n is 0;

when n is 1, m is 0;

when m is an integer of from 2 to 10, the plurality of $R_2$ groups may be the same or different, and the plurality of $R_3$ groups may be the same or different;

$R_1$ and $R_2$, $R_2$ and $R_3$, or $R_4$ and $R_5$ each may be bonded to each other to form a ring; and the compound represented by formula (I) has from 10 to 50 total carbon atoms.

2. The heat-developable color light-sensitive material as claimed in claim 1, wherein the dye-donating compound releases a diffusible dye in correspondence to a silver development.

* * * * *